US010890422B2

(12) United States Patent
Scarr

(10) Patent No.: US 10,890,422 B2
(45) Date of Patent: Jan. 12, 2021

(54) RING AIRFOIL GLIDER WITH AUGMENTED STABILITY

(71) Applicant: Scarr Research and Development Co, LLC, Richmond, IN (US)

(72) Inventor: Kimball Rustin Scarr, Richmond, IN (US)

(73) Assignee: Scarr Research and Development Co., LLC, Richmond, IN (US)

( * ) Notice: Subject to any disclaimer, the term of this patent is extended or adjusted under 35 U.S.C. 154(b) by 0 days.

(21) Appl. No.: 15/218,154

(22) Filed: Jul. 25, 2016

(65) Prior Publication Data

US 2017/0146329 A1 May 25, 2017

Related U.S. Application Data

(63) Continuation of application No. 14/193,855, filed on Feb. 28, 2014, now Pat. No. 9,404,721, which is a continuation of application No. 12/181,190, filed on Jul. 28, 2008, now Pat. No. 8,661,983.

(60) Provisional application No. 60/935,161, filed on Jul. 26, 2007.

(51) Int. Cl.
*F42B 10/36* (2006.01)
*F42B 10/38* (2006.01)

(52) U.S. Cl.
CPC ..... *F42B 10/36* (2013.01); *F42B 10/38* (2013.01)

(58) Field of Classification Search
CPC ..... F42B 10/32; F42B 10/34; F42B 10/36; F42B 10/38
USPC ..... 102/502, 503
See application file for complete search history.

(56) References Cited

U.S. PATENT DOCUMENTS

| | | | | |
|---|---|---|---|---|
| 2,115,028 A | | 4/1938 | Orwell | |
| 2,393,604 A | * | 1/1946 | Berger | F42B 10/06 102/385 |
| 2,784,711 A | | 3/1957 | Vaghn | |
| 2,918,006 A | | 12/1959 | VonZborowski | |
| 3,264,776 A | | 8/1966 | Morrow | |
| 3,340,769 A | | 9/1967 | Waser | |
| 3,400,661 A | | 9/1968 | Coon | |
| 3,415,193 A | | 12/1968 | Campagnuoio et al. | |
| 3,476,048 A | | 4/1969 | Barr | |
| 3,474,990 A | | 10/1969 | Flatau | |
| 3,493,199 A | | 2/1970 | Flatau | |
| 3,526,377 A | | 9/1970 | Flatau | |

(Continued)

FOREIGN PATENT DOCUMENTS

| | | |
|---|---|---|
| EP | 0857940 | 8/2002 |
| EP | 1228342 | 7/2003 |

(Continued)

OTHER PUBLICATIONS

U.S. Appl. No. 12/045,647, Notice of Allowance dated Mar. 21, 2011, 16 pgs. dated Mar. 21, 2011.

(Continued)

*Primary Examiner* — James S Bergin
(74) *Attorney, Agent, or Firm* — John V. Daniluck; Dentons Bingham Greenebaum LLP

(57) ABSTRACT

In one embodiment, a less lethal munition including a ring airfoil projectile. The flight trajectory of the projectile has increased accuracy resulting from the aerodynamic stabilization of the projectile. In some embodiments, the projectile is both aerodynamically stabilized and spin stabilized.

29 Claims, 21 Drawing Sheets

(56) References Cited

U.S. PATENT DOCUMENTS 3,584,581 A 6/1971 Flatau et al.
3,585,934 A 6/1971 Mueller
3,645,694 A 2/1972 Flatau
3,738,279 A 6/1973 Eyre et al.
3,837,107 A 9/1974 Swaim et al.
3,877,383 A * 4/1975 Flatau ..... F42B 10/36 102/503
3,898,932 A * 8/1975 Flatau ..... F42B 12/50 102/502
3,912,197 A 10/1975 McKown et al.
3,919,799 A 11/1975 Austin, Jr. et al.
3,951,070 A * 4/1976 Flatau ..... F42B 12/50 102/502
3,954,057 A 5/1976 Flatau
3,956,844 A 5/1976 Misevich et al.
3,980,023 A 9/1976 Misevich
3,981,093 A 9/1976 Reed
3,982,489 A * 9/1976 Flatau ..... F42B 10/36 102/502
4,052,927 A 10/1977 Flatau
4,132,148 A 1/1979 Meistring et al.
4,151,674 A 5/1979 Klahn et al.
4,154,012 A 5/1979 Miller
4,164,904 A 8/1979 Lavilette
4,190,476 A 2/1980 Flatau
4,212,244 A 7/1980 Flatau
4,246,721 A 1/1981 Bowers
4,270,293 A 6/1981 Plumer et al.
4,301,736 A 11/1981 Flatau
4,337,911 A 7/1982 Flatau
4,390,148 A 6/1983 Cudmore
4,413,565 A 11/1983 Matthey et al.
4,539,911 A 9/1985 Flatau
4,579,059 A 4/1986 Flatau
4,612,860 A 9/1986 Flatau
4,656,946 A 4/1987 Gordan et al.
4,656,947 A 4/1987 Gordon et al.
4,735,148 A 4/1988 Holtzman
4,742,774 A 5/1988 Flatau
4,753,152 A 6/1988 Baechler
4,776,281 A 10/1988 Chiang et al.
4,790,788 A 12/1988 Hill
4,827,847 A 5/1989 Laviolette et al.
4,850,923 A 7/1989 Etheridge
4,882,997 A 11/1989 Baxter et al.
4,936,218 A 6/1990 Wosenitz
4,938,146 A 7/1990 Gunther
4,969,397 A 11/1990 Gunther
H0000942 H 8/1991 Pardee
5,067,406 A 11/1991 Olson et al.
5,275,110 A 1/1994 Flatau
5,303,632 A 4/1994 Kivity
5,317,866 A 6/1994 Murray et al.
5,377,656 A 1/1995 Lewinski et al.
5,397,261 A 3/1995 Malewicki et al.
5,515,787 A 5/1996 Middleton
5,526,749 A 6/1996 Teetzel
5,531,210 A 7/1996 Meiser et al.
5,535,729 A 7/1996 Griffin et al.
5,546,845 A 8/1996 Wossner
5,655,947 A 8/1997 Chen
5,677,505 A 10/1997 Dittrich
5,816,880 A 10/1998 Forti et al.
5,868,597 A 2/1999 Chen
5,936,189 A 8/1999 Lubbers
5,970,970 A 10/1999 Vanek et al.
6,041,712 A 3/2000 Lyon
6,076,511 A 6/2000 Grimm et al.
6,079,398 A 6/2000 Grimm
6,083,127 A 7/2000 OShea
6,145,441 A 11/2000 Woodall et al.
6,178,889 B1 1/2001 Dindl
6,220,918 B1 4/2001 Laronge
6,257,146 B1 7/2001 Stonebraker
6,298,788 B1 10/2001 Woods
6,324,983 B1 12/2001 Dindl
6,324,984 B1 12/2001 Dindl
6,374,741 B1 4/2002 Stanley
6,454,623 B1 9/2002 Flatau
6,564,719 B2 5/2003 Saxby
6,575,098 B2 6/2003 Hsiung
6,599,161 B2 7/2003 Hunter
6,647,890 B2 11/2003 Findlay
6,722,252 B1 4/2004 ODwyer
6,722,283 B1 4/2004 Dindl
6,671,989 B2 6/2004 Vanek et al.
6,742,509 B2 6/2004 Hunter et al.
6,782,828 B2 8/2004 Widener
6,782,829 B1 8/2004 Han
6,832,557 B2 12/2004 Torsten
6,860,187 B2 3/2005 ODwyer
6,915,793 B2 7/2005 Vanek et al.
6,953,033 B2 10/2005 Vanek et al.
6,983,700 B1 1/2006 Malejko
6,990,905 B1 1/2006 Manole
7,004,074 B2 2/2006 Van Stratum
7,007,424 B2 3/2006 Vanek et al.
7,021,219 B1 4/2006 Dindl
D522,070 S 5/2006 Hunter et al.
7,063,082 B2 6/2006 Vanek et al.
7,089,863 B1 8/2006 Dindl
7,165,496 B2 1/2007 Reynolds
7,191,708 B2 3/2007 Quilarin
7,207,273 B2 4/2007 Brunn
7,207,276 B1 4/2007 Dindl
7,287,475 B2 10/2007 Brunn
7,377,204 B2 5/2008 Simmons
7,418,896 B1 9/2008 Dindl
7,444,941 B1 11/2008 Brunn
7,451,702 B1 11/2008 Dindl
7,475,638 B2 1/2009 Haeselich
7,500,434 B2 3/2009 Flatau et al.
7,503,521 B2 3/2009 Maynard
7,549,376 B1 6/2009 Grossman
7,568,433 B1 8/2009 Farina
7,581,500 B2 9/2009 Flatau
7,621,208 B2 11/2009 Huffman
7,654,458 B1 2/2010 Kokodis
7,658,151 B2 2/2010 Genis
7,681,503 B1 3/2010 Fridley
7,793,591 B1 9/2010 Van Stratum
7,802,520 B2 9/2010 Van Stratum
7,819,065 B2 10/2010 Haeselich
7,823,509 B2 11/2010 Dindl
7,890,310 B2 2/2011 Glass et al.
7,987,790 B1 8/2011 Scarr
8,065,961 B1 11/2011 Scarr
8,327,768 B2 12/2012 Scarr
8,511,232 B2 8/2013 Scarr
8,528,481 B2 9/2013 Scarr
8,661,983 B1 * 3/2014 Scarr ..... F42B 10/38 102/502
9,404,721 B2 * 8/2016 Scarr ..... F42B 10/38
9,739,296 B2 * 8/2017 Schlosser ..... F02C 7/045
2002/0088367 A1 7/2002 MacAleese
2003/0000122 A1 1/2003 Vanek et al.
2003/0089221 A1 5/2003 O'Dwyer
2003/0097952 A1 5/2003 Findlay
2004/0000250 A1 1/2004 Stratum
2005/0066843 A1 3/2005 Flatau et al.
2005/0183615 A1 8/2005 Flatau
2006/0096492 A1 5/2006 Flatau et al.
2007/0079819 A1 4/2007 Vanet et al.
2008/0006171 A1 1/2008 Confer
2008/0223246 A1 9/2008 Dindl
2010/0089226 A1 4/2010 Jones
2010/0095863 A1 4/2010 Koinki
2010/0101443 A1 4/2010 Rosales
2010/0132580 A1 6/2010 Nazdratenko
2010/0212533 A1 8/2010 Brunn
2010/0263568 A1 10/2010 Huffman
2010/0282118 A1 11/2010 Ladyjensky

(56) References Cited

U.S. PATENT DOCUMENTS

FOREIGN PATENT DOCUMENTS

| | | |
|---|---|---|
| EP | 1376046 | 1/2004 |
| EP | 1104541 | 3/2004 |
| EP | 0966650 | 9/2005 |
| EP | 1079199 | 10/2005 |
| WO | 8101046 | 4/1981 |
| WO | 8707708 | 12/1987 |
| WO | 9853269 | 11/1998 |
| WO | 9937968 | 7/1999 |
| WO | 2006083280 | 8/2006 |
| WO | 2006092637 | 9/2006 |
| WO | 2008020857 A2 | 2/2008 |
| WO | 2008045131 | 4/2008 |
| WO | 2008099353 | 8/2008 |
| WO | 2009048664 | 4/2009 |
| WO | 2009137370 | 11/2009 |

OTHER PUBLICATIONS

U.S. Appl. No. 12/045,647, Office Action dated Jun. 11, 2010, 29 pgs. dated Jun. 11, 2010.

U.S. Appl. No. 12/045,647, Response filed Dec. 13, 2010, 38 pgs. dated Dec. 13, 2010.

U.S. Appl. No. 12/045,647, Office Action dated Dec. 3, 2010, 5 pgs. dated Dec. 3, 2010.

U.S. Appl. No. 12/181,190, Office Action dated Oct. 4, 2010, 8 pgs. dated Oct. 4, 2010.

U.S. Appl. No. 12/181,190, Response filed Apr. 4, 2011, 36 pgs. dated Apr. 4, 2011.

U.S. Appl. No. 12/181,190, Office Action dated Feb. 28, 2013, 8 pgs. dated Feb. 28, 2013.

U.S. Appl. No. 12/181,190, Response filed Aug. 28, 2013, 24 pgs. dated Aug. 28, 2013.

U.S. Appl. No. 12/181,190, Notice of Allowance dated Oct. 11, 2013 dated Oct. 11, 2013.

Longitudinal Flying Qualities of the U.S. Naval Test Pilot School Flight Test Manual, Fixed Wing Stability and Control, USNTPS-FTM, No. 103, Jan. 1997 Jan. 1, 1997.

Field Manual 3-22.31, Department of Arm, Mar. 19, 2007 Mar. 19, 2007.

U.S. Appl. No. 14/193,855, Office Action dated Jul. 6, 2015, 7 pages dated Jul. 6, 2015.

U.S. Appl. No. 14/193,855, Reponse to Office Action filed Dec. 14, 2015, 21 pgs. dated Dec. 14, 2015.

U.S. Appl. No. 14/193,855, Notice of Allowance dated Mar. 28, 2016, 6 pgs. dated Mar. 28, 2016.

* cited by examiner

RING AIRFOIL GLIDER WITH AUGMENTED STABILITY

CROSS REFERENCE TO RELATED APPLICATION

This application is a continuation of U.S. Patent Application Serial No. 14/193,855, which issued on Aug. 2, 2016 as U.S. Pat. No. 9,404,721, which is a continuation of U.S. patent application Ser. No. 12/181,190, filed Jul 28, 2008, which issued on Mar. 4, 2014 as U.S. Pat. No. 8,661,983 and claims priority to U.S. Provisional Patent Application Ser. No. 60/935,161, filed Jul. 26, 2007, all of which are incorporated herein by reference.

FIELD OF THE INVENTION

The present invention pertains to ring airfoils, and in particular to less-lethal munitions incorporating ring airfoil projectiles.

SUMMARY OF THE INVENTION

According to one aspect of the present invention, there is a ring airfoil projectile whose flight is stabilized both gyroscopically and aerodynamically.

Yet another embodiment of the present invention includes aspects for aerodynamically stabilizing a ring airfoil projectile by placing the center of pressure of the airfoil shape aft of the center of gravity of the projectile.

Yet other aspects of certain embodiments pertain to ring airfoil projectiles having an asymmetric airfoil shape having the longer or low pressure side facing the longitudinal axis of the ring shape, having an angle of attack between the chord line and the centerline, or having drag-inducing features proximate to the trailing edge of the airfoil shape, or combinations of these features.

Yet other aspects of the present invention pertain to a less-lethal ring airfoil projectile whose range of sizes and flight velocities are suitable to provide a stand-off less-lethal weapon system.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these myriad combinations is excessive and unnecessary.

These and other aspects and features of the various embodiments of the present invention will be shown in the drawings, claims, text that follows.

DESCRIPTION OF THE PREFERRED EMBODIMENT

Figure 1:
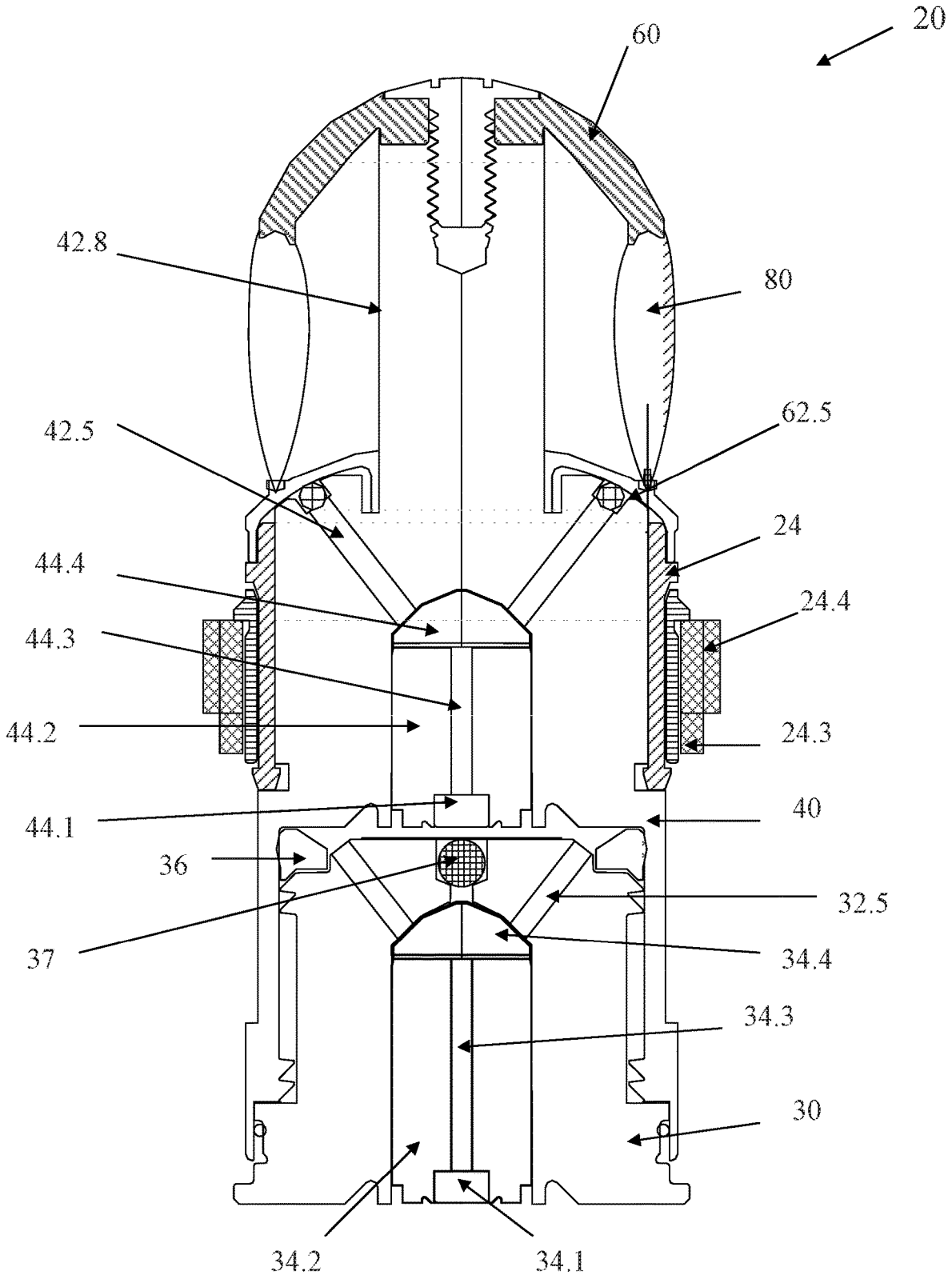
FIG. 1 illustrates a cross sectional elevational view of a munition according to one embodiment of the present invention.
Figure 1B:
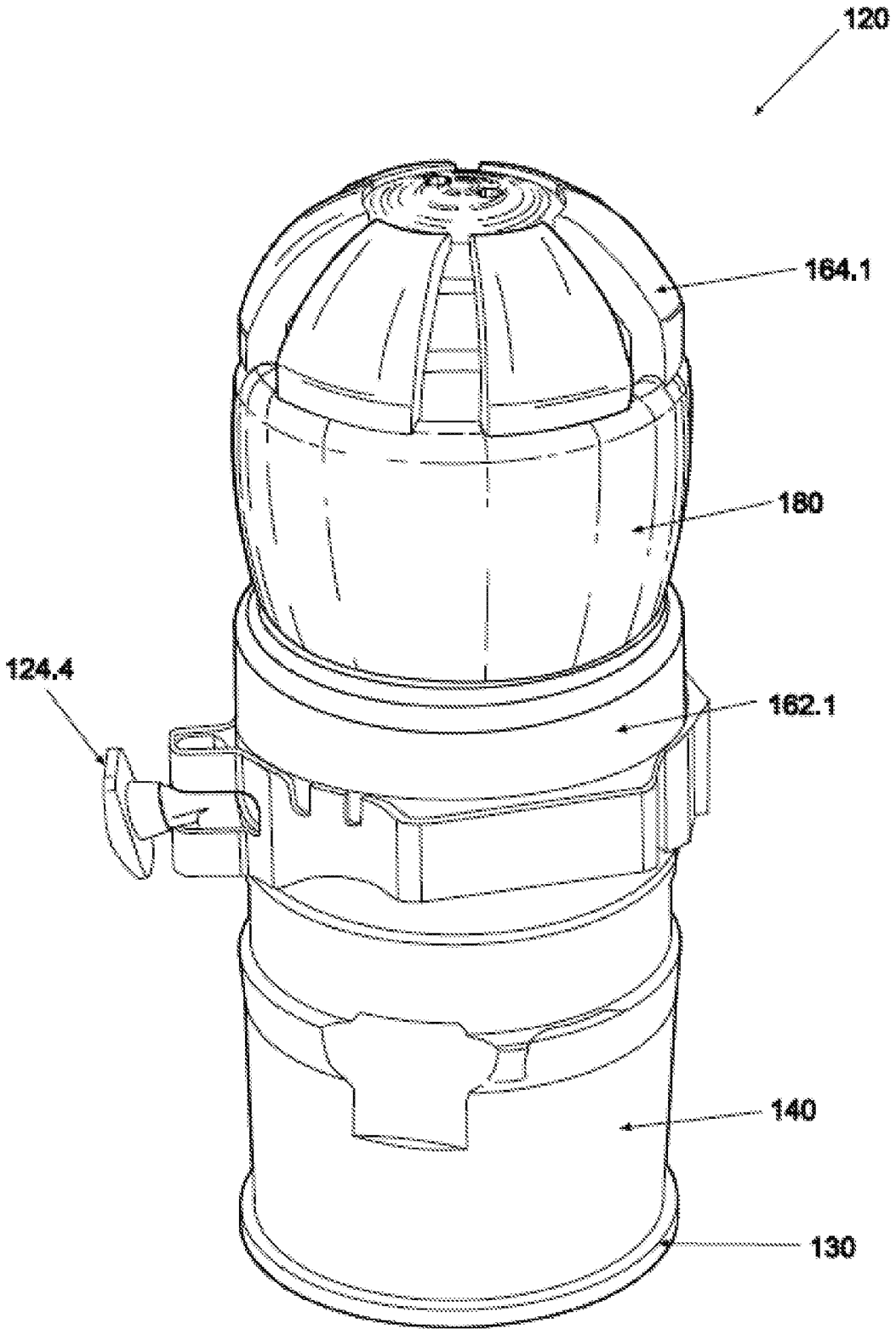
FIG. 1B is a perspective photographic representation of a munition according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, etc.) may be stated herein, such specific quantities are presented as examples only, and are not to be construed as limiting.

Incorporated herein by reference is U.S. patent application Ser. No. 12/045,647, filed Mar. 10, 2008, attorney docket no. 19337-81338.

Ring airfoil gliders are tubular-shaped wings which fly or glide through the air much like a conventional winged glider. Unlike a conventional ballistic projectile, the ring airfoil glider produces lift which gives it a much flatter trajectory. Depending on the design and launching parameters of the glider, the lift results in the glider rising to only small fraction of the height of the trajectory of a conventional ballistic projectile at the same range. The lifting capability reduces or eliminates the problem of range estimation errors and allows ring airfoil gliders to achieve higher hit probabilities at long range than all other candidate low lethality or grenade projectiles.

Conventional ballistic projectiles have their longitudinal axis oriented along their flight path. As the projectile travels through its curved ballistic flight path the projectile changes its attitude or orientation from its original line of departure to align with its flight path. Projectiles have a parabolic shaped curved flight. Conversely, the ring airfoil glider has strong gyroscopic forces induced by the spinning projectile's mass, concentrated near its outer circumference. The gyroscopic stability maintains its original launch orientation, along its line of departure. As a ring airfoil glider proceeds along its trajectory and begins to fall under the pull of gravity, the flight path starts to curve downward toward the ground. Therefore, the glider becomes canted in relation with the airflow over its wing surface causing lift forces to be created on it in the direction opposite to the gravitational pull. This works similar to increasing the pitch of a helicopter's rotor, which is also airfoil shaped, to increase the rotor's lift. Although, the ring airfoil has a slight curve in its flight path until it stalls, at which point it drops rapidly, it appears to the casual observer to travel a straight line and then suddenly fall to the ground. Ufano, a contemporary of Galileo, wrongly thought conventional projectiles traveled like this, perhaps he was thinking of the ring airfoil nearly five hundred years ago.

Ring airfoil gliders, like other glider type or non-powered lifting devices, do not respond well to large or steep angles of attack. Therefore, increasing the loft angle beyond about 10° above horizontal does not increase the distance the ring airfoil glider will travel, as is the case with conventional projectiles like grenades and artillery.

Generally, the higher the peak trajectory above the line of sight, the more difficult it is for the shooter to hit a target: due to his need to estimate how much to compensate for the projectile's drop—a task made more difficult when the soldier is under fire. A useful concept in measuring the necessity of accurate range estimation is the 'danger space.' The danger space is the distance over which the projectile remains within a man's height. If the projectile's velocity is low with a corresponding long flight time, the trajectory curves steeply, and there will be a portion of the range for which the projectile will pass harmlessly over a man's head. In this case, the danger space consists of nearby ranges where the projectile is still within a man's height and the last part of the trajectory, as the projectile falls within the man's height before ending in the projectile's contact with the ground. The latter portion is shorter, as the trajectory is steeper at the end. And, for less lethal devices like the M1006 sponge grenade the nearby ranges are not usable due to the increased risk of unacceptable injuries.

With a flat trajectory like that of the ring airfoil glider, this ineffective zone within the defined effective range is reduced, leaving one continuous danger space from muzzle to the target. This allows the soldier to quickly acquire the target without the need for sophisticated range finders and computers that are useless when the battery runs down—or the hardware or software malfunctions.

Cross wind performance for less lethal kinetic ammunition projectiles has always been problematic. This is due to less lethal lightweight large diameter projectiles having low sectional density and low launch speeds, i.e. easily pushed around by the wind, combined with high velocity degrades resulting in long flight times, i.e. time to be deflected by the wind. The ring airfoil helps to alleviate these problems by decreasing the flight time. However, the lifting effect of the ring airfoil does come into play with cross winds, much like what happens with its drop characteristics. Technically, wind blowing against the glider at low angles of attack, less than 10° to 15°, the lifting force causes the glider to be deflected less than usual for a conventional projectile. As the wind angle increases the lift effect tapers off until it is not present, at which point the projectile behaves like a conventional projectile, although it has a lower flight time, and therefore less deflection. As the wing angle passes beyond ninety degrees and becomes a tail wind at shallow angle, less than 10° to 15°, the glider slightly increases its deflection but this is offset by the reduced airspeed, when traveling with the wind, and the lower flight time. Generally to the shooter, the ring airfoils behavior is usually perceived as much better than a conventional projectile's performance due to the fact that he has no direct comparison to the round he is presently firing. Wind deflection, other than in artillery, is a guessing game for the soldier in the field; he has no means of measuring wind velocity, knowing its precise direction and the time to calculate wind deflection when he fires the weapon—he can only compensate for the next shot, after observing the impact point of the round.

For less lethal operations the ring airfoil glider (RAG) or projectile allows for targeting point and small area targets at ranges of about 100 to 200 meters, depending on design, loading, and launcher. A practical effective range is 125 to 150 meters for point targets, and is at the limits of what soldiers under pressure can successfully target with a hand held launcher. RAG technology may be used for targeting an area target like a mob by the use of a salvo round and/or automatic machine gun type launcher such as the Mk 19 MG. RAG technology meets these goals of deterrence with less likelihood of producing serious or life threatening injury than conventional less lethal ammunition rounds.

The other tactical advantage the ring airfoil provides, in peacekeeping missions in 'dangerous and armed populations', is maintaining a safe perimeter or separation distance between the peacekeepers and the population. The less lethal ring airfoil glider can be an effective deterrent against incursions into the danger space of small arms to 250 to 300 meters. The preferred launcher for this use would be the Mk 19 machine gun type automatic launcher.

The differences between momentum and energy effects of a projectile to the human vulnerability rating of that projectile. It took several hundred years for some of the great minds in physics such as Galileo and Newton to develop an accurate intuitive understanding and analytical means to describe the quantitative of the simple laws of nature. Simple as they are, most of us sometimes have a hard time grasping the quantitative knowledge and understanding. We usually function in our understanding more along the lines of the intuitive Aristotelian view.

To begin with, movement is defined quantitatively as velocity. Velocity is distance divided by time. All moving bodies have momentum. Momentum is defined as the mass times the velocity. It only relates to moving mass. Newton's law of conservation of momentum is that the momentum of moving body is conserved when that body strikes another body. Maybe the best way of defining it for our purposes; momentum is the property of a moving body that determines the length of time required to bring it to rest. In collisions between a projectile and a human, it describes the effect that pushes or moves the person. It is the effect that shoves your shoulder back when firing a gun or moves your body when a projectile hits you. It is impossible for a shoulder fired weapon to knock a person over without knocking the shooter over also; cases of the person targeted losing balance are cases of shock and muscle contractions causing one to fall down from the impact—not momentum effects.

Momentum is the movement of a body directly resulting from an impact. Momentum does not tear tissues, produce friction, and a heating effect in tissues: only shoves or moves them. Newton describes kinetic energy as the velocity squared times the mass. Energy is the capacity to do work. Kinetic energy is that stored in a moving body. Energy tears tissues, produces a heating effect due to friction, produces pain, and in general produces the damage, i.e. work, caused by an impact. The energy of a projectile is conserved in an impact with another body by changing the energy of motion of the projectile to the energy of motion of the impacted body if it develops movement, any heat energy, and work or physical changes in the body like deformation or other damage. Basically, if one is injured by the impact of a projectile it is the kinetic energy that injures. It is the effect that 'hurts' your shoulder when firing a gun or when a projectile hits you. As with momentum, energy is always conserved.

Any moving body or projectile has both momentum and kinetic energy. It is many times not obvious really what the difference between energy and momentum is, particularly, when one is dealing with projectiles hitting people. This difference can best be understood when the terms elastic and inelastic are applied to a collision. In perfectly elastic collisions the momentum and kinetic energy directly transfer and there are no losses due to deformation or heating effects due to friction. This never happens in nature; a ball never bounces as high as it is dropped, no matter what is made of or dropped on. Basically, inelastic collisions cause deformation and heating of the bodies involved, reducing their kinetic energy; some of the ball's energy is changed into heat when it hits the floor—the real world. And, as it takes time to deform the ball the total velocity is reduced to conserve the systems momentum.

If heavy and light projectiles at the same kinetic energy level, with the heavy projectile having much higher momentum, are fired at and stopped by free hanging golf practice nets the following occurs: when nets catch a heavy and slow moving projectile they always are moved back forming a very deep cone shaped depression several feet deep, as they stop the projectile; conversely, when the nets catch a light but fast moving projectile they are only pushed back a few inches.

This difference is due to the momentum effects difference. However, a very fast light projectile may break and tear some cords in the netting, damaging it, while the heavy projectile leaves the netting undamaged. Remember, both types of projectiles hit the exact same medium with the same resistance and strength. This discussion will help in understanding the human effects of projectiles.

Human vulnerability research including animal experiments has determined: a non-penetrating projectile impacting flesh is called a blunt trauma producer; kinetic energy does the damage—tears tissues, ruptures blood vessels, breaks bones, and the like—it is what is dangerous; and momentum is 'felt' as a shove and does not in of itself injure.

However, the momentum does factor into the injury from a non-penetrating projectile in an interesting way. It effects how deep the deformation from the projectile travels. This is not like a 'shock, or more precisely, pressure wave' as is seen in skull impacts, wherein, the wave travels deep into the fluid filled brain cavity. These 'wave' effects do damage and injure and are produced by the kinetic energy of the projectile. The depth of the deformation is partially due to movement of the tissues by the projectiles momentum. During the time the deformation is formed in the tissue, the stretching, tearing, and rupture of the underlying tissues dissipates kinetic energy. Simply, a deeper deformation drives the injury producing damage deeper into the body structure. For an equal diameter and kinetic energy level a heavier projectile will damage tissues more deeply than a light one—remember the capture net example. A light projectile results in a shallower injury zone than a heavy one. Although, the overall damage to tissues may be equal. Another way of explaining this is in terms of energy transfer 'rate', i.e. how quickly the energy is transferred, remember; momentum is the property of a moving body that determines the length of time required to bring it to rest. The longer the time it takes to stop the projectile the more the tissue will be deformed. For the same kinetic energy level, a heavier projectile takes longer to stop than a light one, meaning; the heavy projectile will form a deeper cavity into a given tissue than a light one.

Sometimes, a deformable projectile nose is used to limit the injury produced by a non-penetrating projectile. The M1006 sponge grenade was designed with this in mind. The M743/742 RAG also had a deformable front section simply as a side benefit of the CS pockets. If the projectile's deformable section is 'softer' than or preferably equal in deformation resistance to than the body tissue encountered this works to limit injury in two ways: by dissipating the kinetic energy in the projectile due to its deformation, turning the kinetic energy to heat, like happens when a rubber ball is bounced on the floor; and by increasing the time (decreasing the rate) the energy is dissipated to the tissues. The projectile does part of the deformation to limit the depth of deformation of the tissue.

Usually, it is very hard to have this deformation effect with soft non-penetrating projectiles to spread the energy in a direction perpendicular to the direction of impact. If the projectile nose is softer than or equivalent in resistance to the impacted tissue, it would not have sufficient structural integrity to transfer much energy through cantilever action of the projectile nose. The deformed or cantilevered part of the projectile would have to have sufficient mass to basically rearrange the mass distribution of the projectile perpendicular to its direction of travel.

There is a trade-off between the poor aerodynamics of the large cross-sectional area weapons required to prevent the blunt-trauma weapon from being a penetrating one. A ring airfoil glider projectile's has improved aerodynamic and terminal performance is the trade off between its cross-sectional area, the density and resilience of the medium in which it travels.

Ring airfoil gliders have low aerodynamic drag properties due to their streamlined shape and low cross-sectional area. The fluidity and low density of air drastically reduces drag forces on a ring airfoil glider as the air simply passes through the center of the projectile, rather than traveling around the entire projectile's perimeter. On the other hand, a ring airfoil glider encountering flesh has a very low ballistic coefficient, as flesh is a high density, viscous, elastic solid. Flesh cannot flow through the hole in the center of the ring airfoil glider at the practical speeds that a less lethal ring airfoil travels. Therefore, the ring airfoil glider's energy is dissipated on the surface over an area encompassed by the outside diameter of the projectile, an area much larger than its aerodynamic cross-section.

Upon impact, flesh will not flow through the 'hollow' ring airfoil it will 'bulge' into the center opening. If looked at in section, this phenomenon deforms the flesh into a 'W' that stretches the skin and immediately subcutaneous tissues much more than the 'U' shaped deformation of a conventional rubber bullet or sponge grenade. This 'W' deformation and stretching not only dissipates the energy of the projectile faster than the 'U' shaped deformation, but more in the outer layers of flesh. In fact, the 'U' shaped deformation tends to transfer the energy deeper into the tissue which creates much more dangerous damage to vital tissues and organs. However, the 'W' shape creates a wider surface bruise than that produced by a conventional rubber bullet. This is good, as most of the body's pain receptors are in the skin and outer tissues.

A ring airfoil at the same energy level will produce more pain but less permanent or life threatening damage than a conventional projectile. A simple demonstration of how the localized stretching and deformation of the flesh is more effective than a flat blunt blow can be readily made with everyday objects. An example of similar effects in producing pain is comparing the difference between a wooden mallet with a flat and smooth face compared with a mallet like used for meat tenderizing with a coarse pattern of serration on its face. If one experiments with both mallets by smartly striking each over a range of force and speed against the flesh on the forearm, the back of the hand, or palm it will be readily apparent that the serrated tenderizer type mallet produces more pain than the plain face mallet. One will notice that even with less force, i.e. energy, the serrated mallet produces more pain. The actual area of contact is less with the serrated mallet even when the mallets are the same diameter and the impacted area is the same for both mallets. The difference in pain production is due to both the increased localized deformation and associated stretching of the skin and the comparatively sharp points of the serrations compared to the smooth face and rounded edges of the blunt mallet, and because the points create higher point of contact pressure.

The skin and subcutaneous structures of the body contain most of the pain receptors in the body. Blunt blows transfer energy into deeper tissues that are more critical to life and functioning of the body but are not as effective at producing pain. Also, the pain receptors most efficient at producing pain need high unit pressures to achieve the maximum pain effect. This is why a prick with a needle can create a high level of pain even though a small area is affected. Comparatively, the serrated mallet affects more pain receptors, and the higher level of pressure in the localized areas of the serrations stimulates the high level (pressure) pain receptors more effectively. Additionally, the sympathetic nervous system dilates the capillaries in the injured area further stretching the area thereby increasing the skin temperature; this causes more localized pressure and spreads over a wider area causing more receptors to be affected while allowing rejuvenation of the originally injured nerve ends to intensify the perceived pain. The ring airfoil performs like the serrated mallet.

The ring airfoil projectile allows for significant reduction in the mass of the projectile for the same effective area proportionally reducing any blunt trauma injury while increasing the pain effect. Achieving the maximum pain effect with the smooth mallet or conventional less lethal projectile will make for a severe or life threatening injury. It should be noted, the pain phenomena and functioning of the autonomic nervous system are the least understood of all the body's systems and strangely can produce the maximum pain perceivable when very small areas of the skin are stimulated, an example: a small sharp object which does not even penetrate the skin or really injure the body other than trivially can be very painful.

One way of determining the maximum pain effect for a kinetic energy projectile weapon, while producing minimal injury, is the point where the skin's capillaries are just ruptured to produce a persisting red rash (on magnified inspection tiny blood blisters are produced in the area) with little or no damage to deep tissues. The M232/233 ring airfoils had their performance tailored to achieve this maximum pain point over their entire effective range, from muzzle to 60 to 80 meters. The rash is a ring shaped finely speckled red area corresponding to the contact area of the ring airfoil with the skin at the point of maximum stretching. The pain effect has been described as equivalent to that when produced by an index finger is broken before with a 32 oz hammer, although with the RAG no physical impairment was evidenced, even shortly after the impact. Conventional less lethal munitions like the M-1006 sponge grenade cannot achieve this type of effect as their energy dump rate is too slow and they cannot stimulate the high pressure pain receptors, due to the soft nose, without having very high risk of killing or permanently injuring the target. Notably, a 36-41 mm ammunition can deliver the similar effects as the original RAG M232/233 over a significantly greater effective range and in many ballistic performance categories thebe superior.

Figure 29:
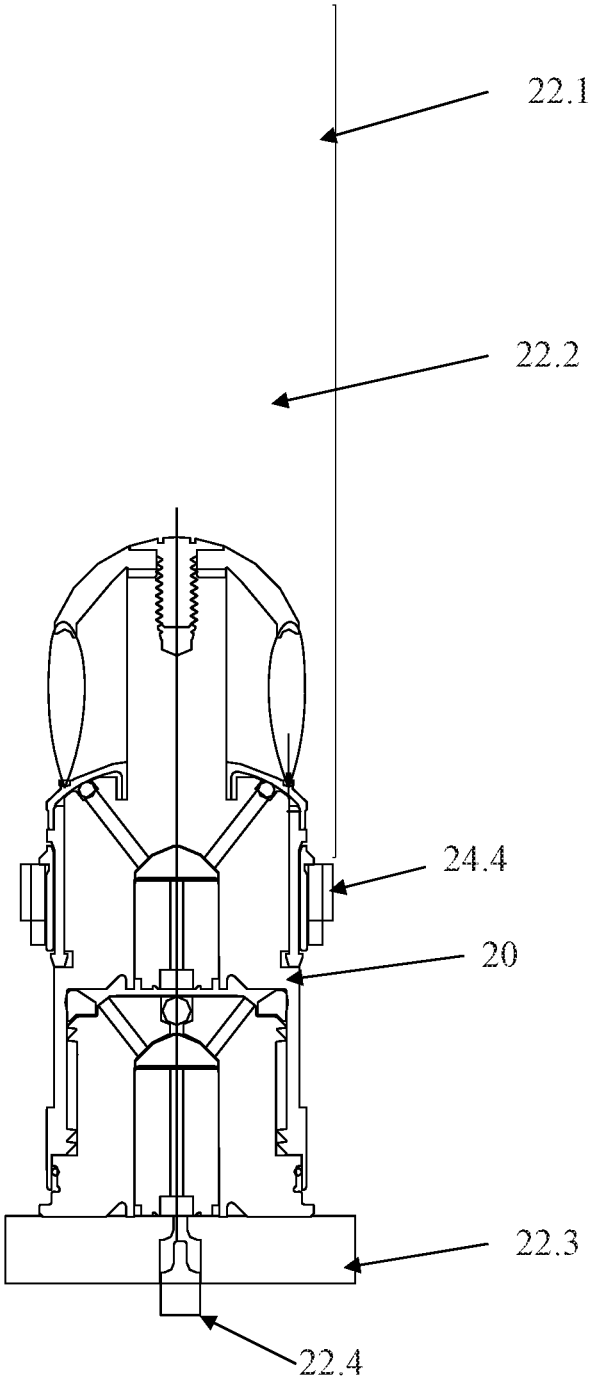
FIG. 29 illustrates a cross sectional view of the assembled ammunition round, Feeding into chamber of a gun
Figure 30:
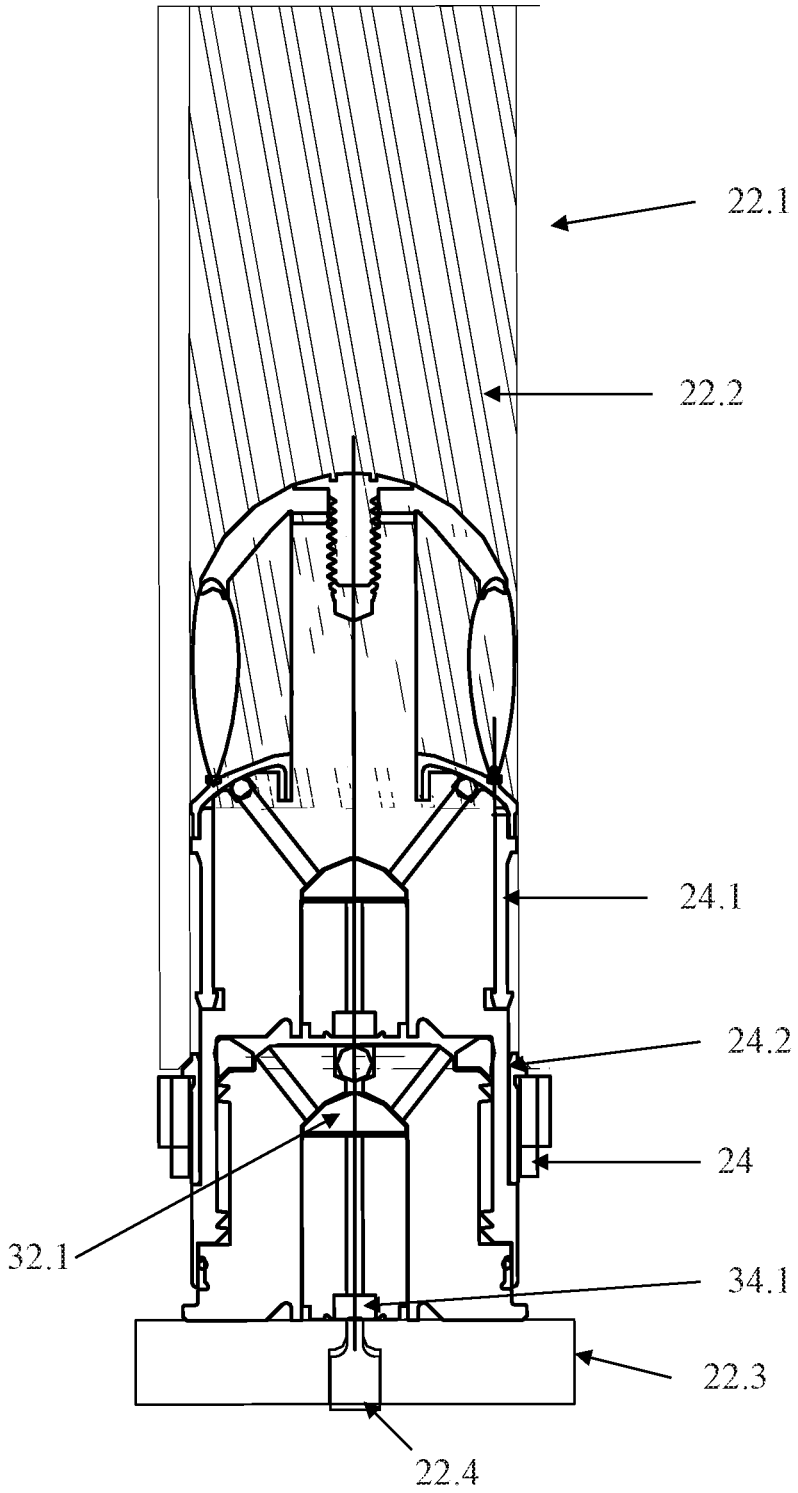
FIG. 30 illustrates a cross sectional view of the assembled ammunition round chambered at the firing point in a gun barrel
Figure 31:
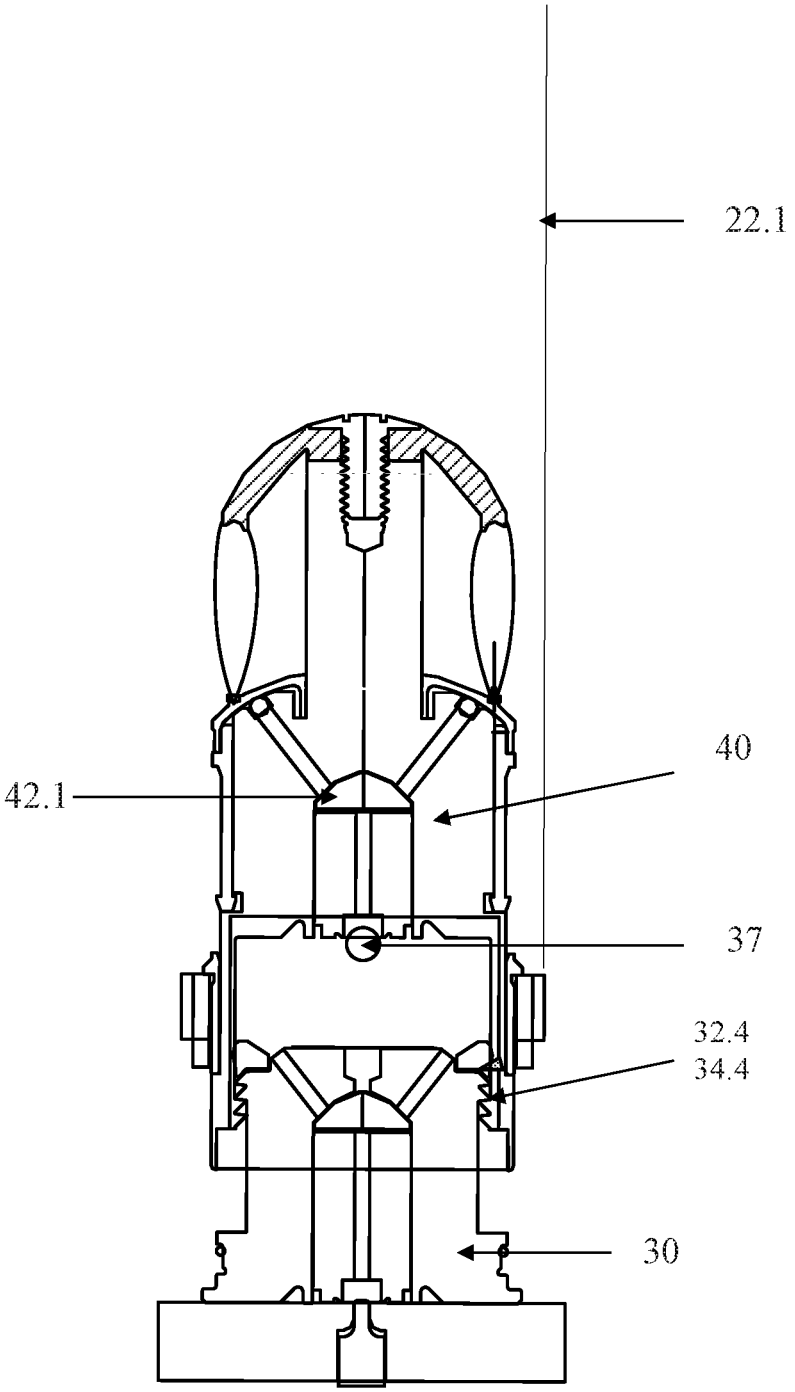
FIG. 31 illustrates a cross sectional view of the assembled ammunition round as the round telescopes and fires the payload
Figure 32:
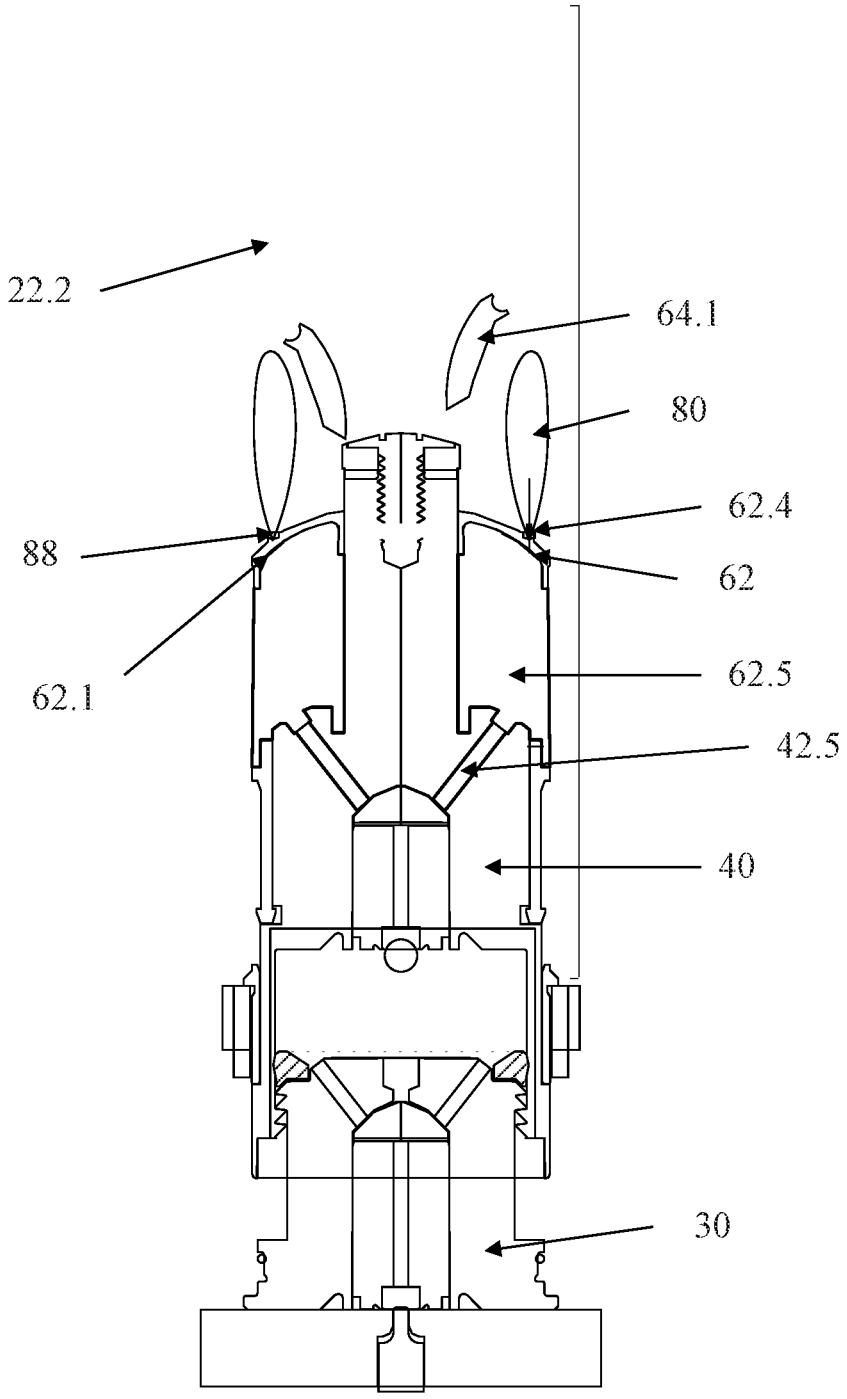
FIG. 32 illustrates a cross sectional view of the assembled ammunition round as the ring airfoil projectile is launched in the barrel chamber

Upon being on the bolt face in the ready battery position, latched and ready to be fired, the trigger is pulled. The bolt travels forward (see FIG. 29), until the firing pin is released, about 1" from the breech face (see FIG. 30). The pin strikes the aft telescoping charges primer initiating the propellant. In FIG. 31, simultaneously an initiation ball is propelled forward to a primer for the forward payload propelling charge, the gas generated by the burning of the propellant builds up pressure and ruptures a rupture disc and the gas escapes through vents and is sealed in telescoping chamber by telescoping seal and the expanding gas reacts against the telescoping piston to open the action and imparts enough momentum to the breech block to auto load the next round and function the gun through the action of the link mount pressing against the chamber entrance chamfer on the Mk 19 barrel. In FIG. 32, once the forward primer has fired the forward payload propelling charge the gas generated by the burning of the propellant builds up pressure and ruptures a rupture disc and the gas escapes through vents and is sealed in telescoping chamber by telescoping seal and the expanding gas reacts against expands against the sabot/pusher pushing it forward while fracturing the projectile retainer along one or more separation groove(s) on the central hub of the retainer releasing the sabot and projectile assembly for forward travel.

Figure 33:
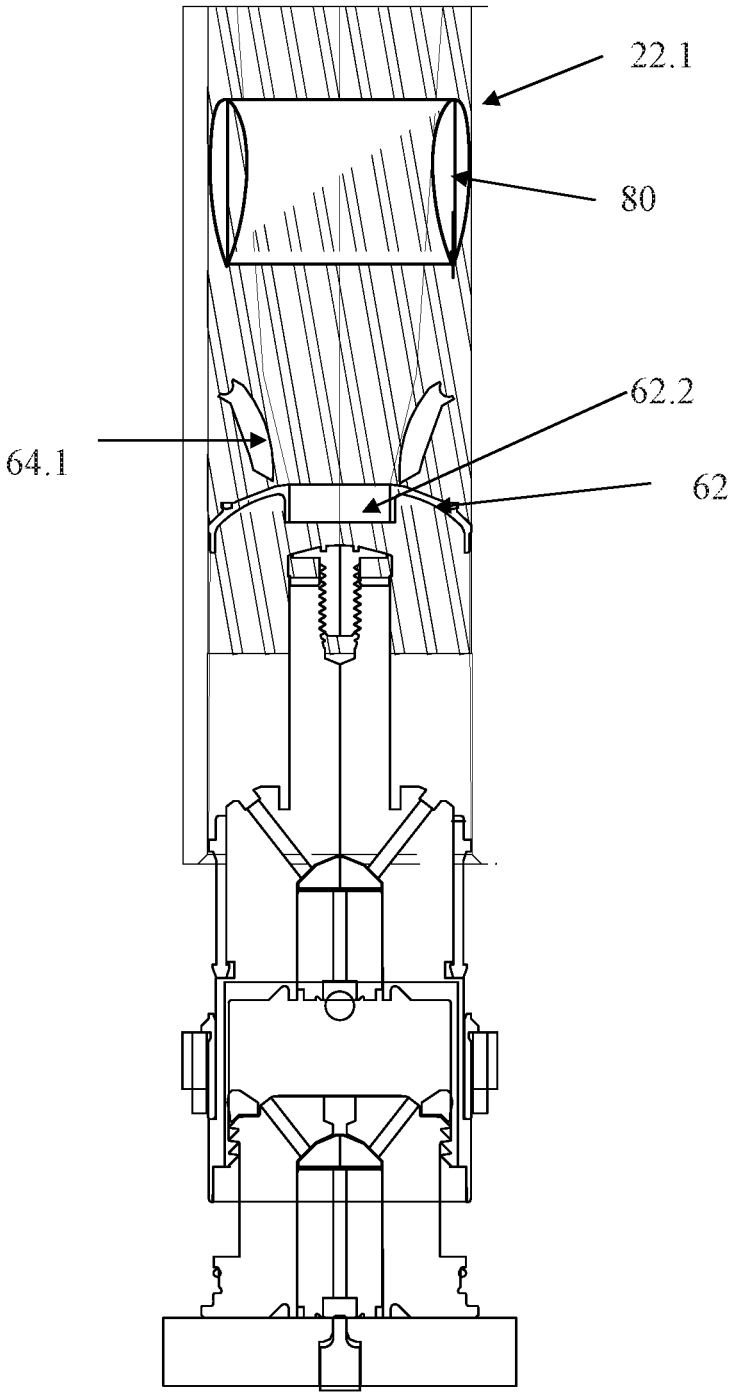
FIG. 33 illustrates a cross sectional view of the assembled ammunition round as the ring airfoil projectile is released to travel down the gun bore as the round begins ejection
Figure 34:
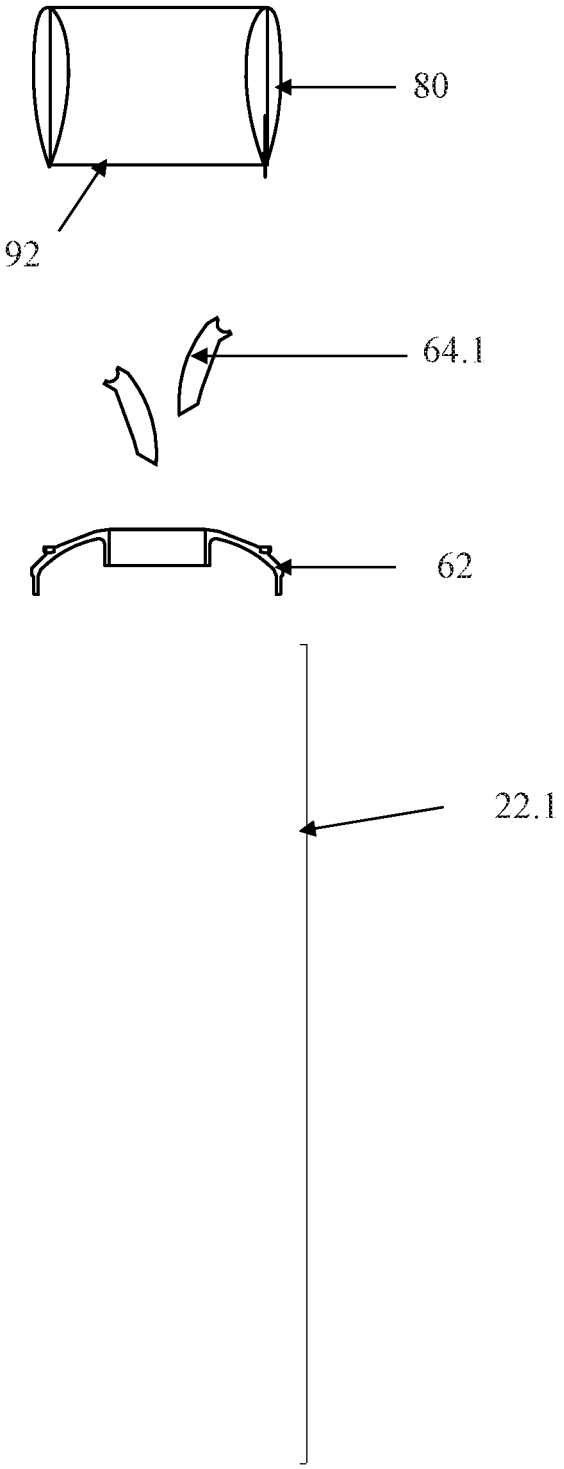
FIG. 34 illustrates a cross sectional view of the assembled ammunition round as the ring airfoil projectile and FOD and Sabot/pusher exits the muzzle.

In FIG. 33, the sealing and rotating band on the sabot seals the propelling gas from the action at the forcing cone of the chamber. The sabot/projectile assembly is pushed along the bore on the center guide mandrill, throughout the launch sequence. The sabot/projectile assembly travels down the bore to the end of the guide mandrill having spin imparted to the assembly by the action of rifling in the gun bore rotating, conversely the spin can be generated by action of rifling on the sabot, as shown in FIG. 32 either alone or in concert with that imparted by the rifling in the bore, the sabot interface which rotates the sabot which transfers the rotation by the action of drive dogs on its forward face engaging slots in the tail of the ring airfoil projectile. As the sabot leaves the mandrill the propelling gas are vented down the center of the sabot own the bore ahead of the sabot/projectile assembly, protecting the ring airfoil projectile, from disturbance by the gas, at which point the maximum velocity is achieved for both the sabot and projectile. The sabot immediately begins to decelerate due to friction with the bore this causes the projectile to separate, as it has no contact with the bore and little friction retarding its passage down the bore; the projectile rides a turbulent boundary layer of air between its outer diameter and the bore guiding and centering it until it exits the muzzle. In FIG. 34 the broken off plastic petals of the projectile retainer and the sabot exits the muzzle at greatly reduced energy and the sabot or pusher rapidly decelerates due to base drag and remains stable face forward in flight; whereupon, the ring airfoil is free to fly towards the target while maintaining its low drag and low trajectory to target.

Figure 36:
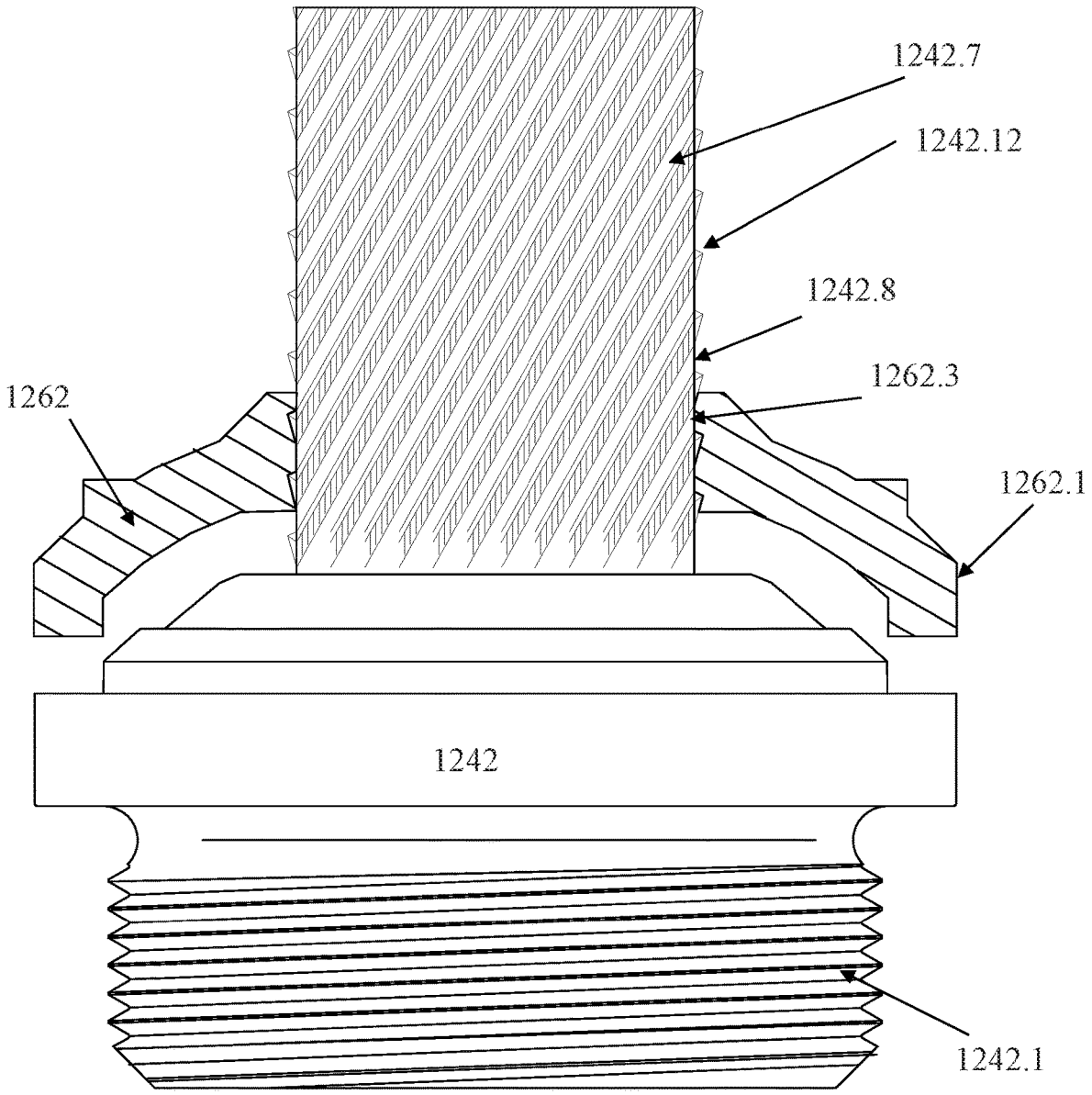
FIG. 36 is side elevational view and partial cross sectional view of a portion of ammunition according to another embodiment of the present invention.

Various embodiments of the present invention are applicable to the Mk 19 machine gun, 40 mm M203 grenade launcher, the Milkor™ six shot revolver launcher or the 37 mm six shot Arwin™ revolver launcher. This technology was applied to work in the Mk19 machine gun as above with the addition a telescoping piston device 40 to function the autoloading mechanism of the Mk 19 machine gun. One difference between the two is that the single shot version works in launchers will very long chamber sections such as the Milkor™ and the Arwin™ launchers. As the ring airfoil projectile 80 does not contact the bore to gain spin and the launch sequence travel of the round is very short and defined by the length of the central mandrill the sabot may not ever contact the bores rifling until it has passed beyond the end of the mandrill, so it is sometimes helpful to use a rifled mandrill with coinciding rifling on the inside diameter of the sabot. The single shot version of this round 1220 uses the ring airfoil components attached to a rim adapter to adapt it to single and multi shot launchers. The rim adapter has a rim for interfacing with the launchers barrel, breech and ejection or extraction components. A primer is housed on the aft centerline of the adapter with a passage for the flame from it leading to the propellant charge. One embodiment of the present invention includes ammunition 1220 (a portion of which is shown in FIG. 36) that is fired from a gun. Operation of a munition 1220 will now be discussed (and is similar in some respects to the launching operation shown in FIGS. 29-34, with one difference being rotation of the projectile imparted by rifling of the central rod 1242.7.

Upon firing, the launchers firing pin hits the primer which initiates the propellant Gas builds up pressure rupturing a copper rupture disk and is released through vents and is sealed by the base of the round and sabot, the propelling charge expands against the sabot/pusher pushing it forward while fracturing the projectile retainer 1264 along one or more separation groove(s) on the central hub of the retainer releasing the sabot and projectile assembly for forward travel The sealing and rotating band on the sabot seals the propelling gas from the action at the forcing cone of the chamber; the sabot/projectile assembly is pushed along the bore on the center guide mandrill 1242.7 which is rifled to impart spin on the sabot. Throughout the launch sequence; the sabot/projectile assembly travels down the bore to the end of the guide mandrill having spin imparted to the assembly by the action of rifling on the rod 1242.7 and the sabot interface 1262.3 which rotates the sabot which transfers the rotation by the action of drive dogs on its forward face engaging slots in the tail of the ring airfoil projectile 1280. As the sabot leaves the mandrill the propelling gas are vented down the center of the sabot own the bore ahead of the sabot/projectile assembly, protecting the ring airfoil projectile 1280, from disturbance by the gas, at which point the maximum velocity is achieved for both the sabot and projectile; the sabot immediately begins to decelerate due to friction with the bore this causes the projectile to separate, as it has no contact with the bore and little friction retarding its passage down the bore; the projectile rides a turbulent boundary layer of air between its outer diameter and the bore guiding and centering it until it exits the muzzle The broken off plastic petals of the projectile retainer and the sabot exits the muzzle at greatly reduced energy and the sabot or pusher rapidly decelerates due to base drag and remains stable face forward in flight; whereupon, the ring airfoil 1280 is free to fly towards the target while maintaining its low drag and low trajectory to target.

One challenge presented with ring airfoil gliders or projectiles has been how to stabilize the flying body of the ring airfoil as it travels toward a target. In aircraft and remotely piloted vehicles this is achieved at some complication by the application of rudders, ailerons, fins, tails and various other movable control surfaces. In flying wing technology like the Northrop developments similar moveable control surfaces are used. Arrows use feathered tails. Bullets and artillery projectiles usually use spin, although, in recent developments fins are used or even control surfaces. In some ring airfoils there has been the use of gyroscopic forces like those used in artillery or other projectile technologies. Some attempts have been made to achieve a stabile flying ring airfoil body by the use of a tail like an arrow.

One embodiment of the present invention achieves some stability in the flying body of a ring airfoil by the use of aerodynamic forces developed by the shape of the ring airfoil basic airfoil section and the application of aerodynamic force internal to the duct features available in the ring airfoil configuration, in concert with some spin or gyroscopic stabilization. This allows some embodiments of the present invention such as the ring airfoil 80 to be applied to standard guns without the need for a special twist rate barrel rifling to achieve high levels of spin. Some spin and some aero dynamic forces would both be of benefit applied to stabilizing a ring airfoil. Intuitively, this seems counterproductive, since the additional aerodynamic forces result in increased drag which lowers the range of the projectile for a given propulsive charge. In the case of ring airfoil glider or projectile technology, using only spin stabilization (and not placing the center of pressure aft of the center of gravity, as in the inventive projectiles shown herein) results in several negative tradeoffs:

Firstly, the spin needed to stabilize a ring airfoil projectile is greater than that need to stabilize a bullet or grenade projectile this limits the application to only special launchers; special barrel rifling twist rates if used in conventional bullet or grenade firing platforms making the conventional gun unsuitable for use with other standard ammunition types, or; by use of special design cartridge ammunition wherein the spin is provided by mechanism within the ammunition.

Secondly, the spin used to stabilize a ring airfoil projectile creates undesirable curved flight paths if the center of mass and center of pressure are not coincident due to the action of gravity and the centripetal forces on the projectile. Even if these are perfectly aligned at one angle of attack of the ring airfoil body another angle of attach will change the pressure balance. Conversely, at one velocity the centers of mass and pressure may be close but at another they may diverge. This velocity phenomenon is part and parcel of a projectile in that it must lose velocity as it travels down range. And, to overcome the velocity difficulty the design of the airfoil section of a ring airfoil is usually limited to some evenly cambered design which is also a partial solution to matching up the center of mass and pressure in the first case described above.

Thirdly, if the ring airfoil projectile is launched even slightly imperfectly the high centripetal forces on it, due to the spin stabilization, can cause it to develop a yaw or wobble in its flight path resulting in a spiral flight path. The spin stabilization forces does not tend to self correct this yaw with the ring airfoil, as in conventional projectiles, but makes it more pronounced. The level of the yaw effect is added to by the lifting forces on the ring airfoil due to the angle of attack effecting the lift generated on the ring airfoil making it wildly unstable when launched imperfectly. This effects accuracy of the ring airfoil and may make the target the safest place to be.

Fourthly, it makes the ring airfoil a more expensive ammunition to employ in comparison with conventional grenades and bullets as the special guns, modified guns, more complicated ammunition, more requirements for precision in design and construction simply cost more is spite of the fact that manufacturing cost of a ring airfoil projectile can be cost competitive with a conventional one, projectile to projectile.

Figure 5:
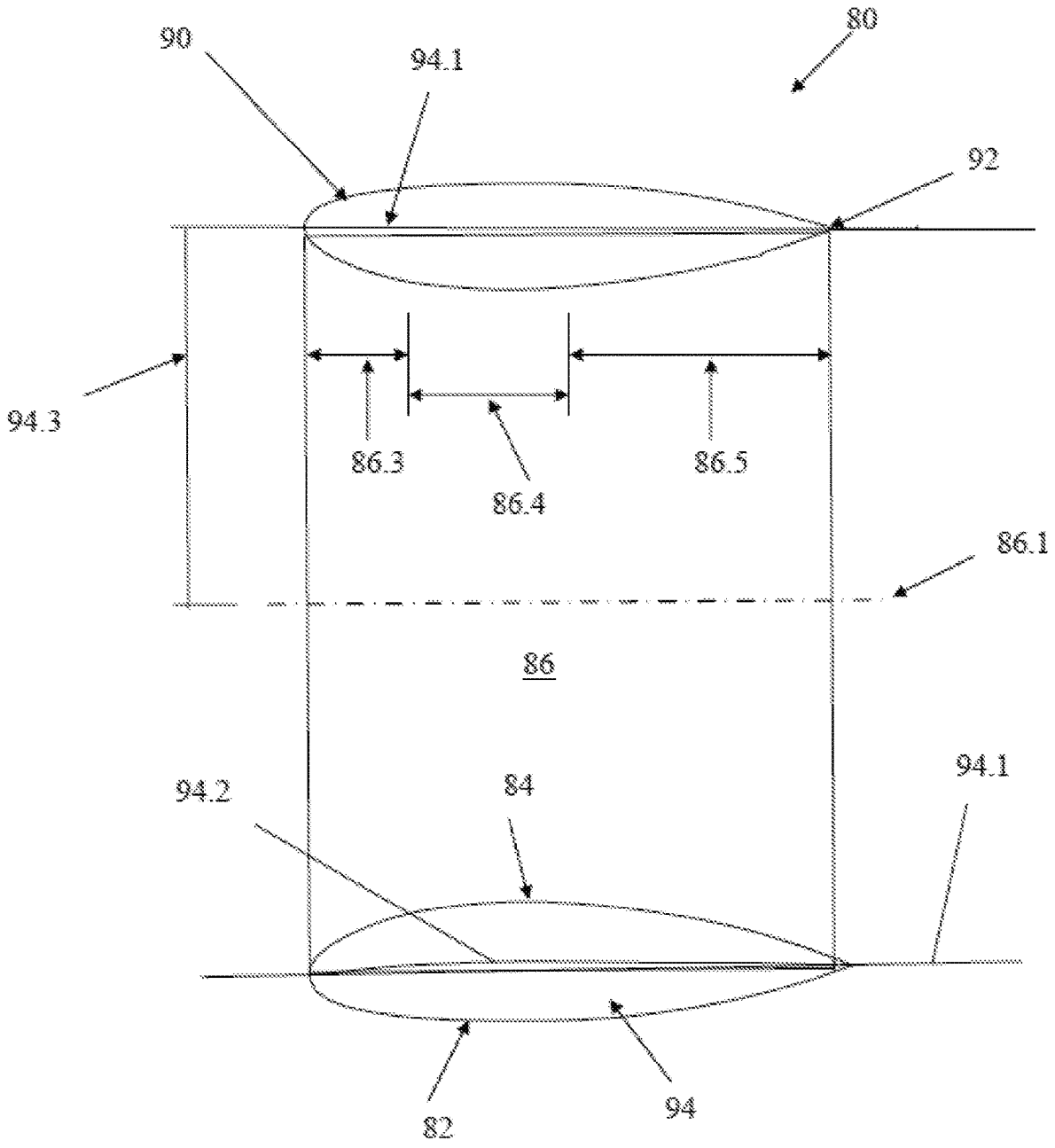
FIG. 5 is a cross sectional and side elevational view of a projectile according to one embodiment of the present invention.

In this regard, the various embodiments of the invention described in this specification are based on the real world cause and effect as they relate to subsonic and less lethal ring airfoils. The field of supersonic ring airfoil invention and technology is unrelated to that of the subsonic variety as even the basics theories of design and engineering practice seem at odds; so herein in this invention it is primarily used in the subsonic area. Even so, the interactions of effects of inlet, throat and outlet airfoil (respectively, sections 86.3, 86.4, and 86.5, as shown in FIG. 5) through the duct of a subsonic ring airfoil body is much more interrelated and critical than that of a supersonic ring airfoil. The effect of Reynolds number and other systematic effects is very critical to the successful application of any invention regarding ring airfoils or other aero dynamic devices. In fact, even in the field of subsonic ring airfoil, the effect of size, length to diameter ratios, chord thickness and the like effect the function of the devices to such an extent that which would work for one application might not either have any effect or preclude its use for another application.

Effects of scaling can only work over limited ranges. Some embodiments of the present invention described herein are in a range of the basic sizes of the ring airfoils in the range of 35 mm to 45 mm and overall lengths of around 20 mm to 35 mm. Conversely, exceeding an initial launch velocity range of about 150 m/sec., on the upper range, and about 50 m/sec., on the absolute lower range, would be outside the applicable aero dynamic range for some embodiments of this invention. For less lethal applications these launch velocities can establish outer limits of danger of severe injury on the higher end and ineffectual deterrent results on the lower end. In regarding the less lethal effects the range of ring airfoil projectiles or more properly glider masses are about 5 to about 20 grams. One of the important benefits of the less lethal ring airfoil glider is the ability of the technology to successfully apply very low mass projectiles in the real world. Even the lightest of conventional 40 mm less lethal projectiles have a mass in the range of 35 to 40 grams wherein a 40 mm ring airfoil would usually be in the range of 9 to 18 grams with the lower end of that scale being preferred. This limits the injury effects and enhances the efficiency of the system as previously described. These are the general parameters as to applicable range of opportunity as to successful function and application of this invention.

In the discussion of ring airfoil technology the effects of spin on the aerodynamic performance complicates the matter but contributes positively in reduction of boundary layer thickness. Usually, most wing flying bodies only move in one direction such as the case with airplane wings. Of course, wings can experience side slippage but this is not a normal airflow situation with the wing. And, conventional wings do have longitudinal flow when not using winglets or end plates to prevent the tip leakage and the resulting vortexes created by the differential pressure existing across the thickness of the airfoil. Ring airfoils do not have tip leakage but usually have spin of the ring airfoil body around the centerline of the duct. This creates a turbulent boundary layer as it is at an angle with the normal air flow over the wing surface. This turbulence thins and more evenly distributes the boundary layer over the ring airfoil surfaces, particularly in the duct. This increases the ability of a ring airfoil projectile section to maintain attached airflow and increases the maximum possible angle of attack.

Base drag with conventional solid body projectiles is that due to the low pressure area formed behind a projectile due to the separation of airflow at the base or tail of the projectile, a suction or low pressure area which creates a drag on the projectile. In a ring airfoil glider or projectile base drag may not be created due to the hollow tube center and the streamlined shape of the airfoil section. However in the present invention, modifying the normally streamlined airfoil section by modifying the tail section of the airfoil (as shown in FIGS. 23-28), by use of high internal to the duct cambered airfoil in comparison with the camber on the outside of the duct or by use of a positive or negative internal angle of attack something very similar to the effects of base drag can be created. Also, the low pressure area above the wing section camber on the inside of the duct can be moved behind the center of mass of the ring. These means effectively and with relative efficiency can create a type of base drag on the inventive ring airfoil to provide drag forces to aerodynamically stabilize it. Inventive ring airfoil designs according to various embodiments of the present inventions either alone or in concert with a ring airfoil section with a larger camber on the inside of the duct than on the outside of the ring airfoil body can create an aero dynamic stabilization force on the ring airfoil that reduces or possibly eliminates the need for high spin rates. This last works simply by the amount of the camber and its location in the fore and aft direction. Previously in ring airfoil technology, neither has high duct camber internal angle of attack or modifications to the tail configuration have been applied to stabilize the ring airfoil body by aero dynamic forces. Herein, some embodiments of the present invention use these features to create an aerodynamic drag on the projectile to provide serodynamic stabilization forces it in addition to the spin stabilization. It may even be possible to completely stabilize the projectile with these aero forces.

In one aspect of some embodiments of the present invention, is to use a cut off tail of the ring airfoil to create an effective base drag on the ring airfoil. FIGS. 23-28 show various tail configurations to achieve base drag on the ring airfoil. A simple flat section of the cut off tail creates and annular area of low pressure to create a base drag to stabilize the ring airfoil. Similarly, a recess in the cut off tail or internal or external lips may be used to increase the drag of the projectile and locate the center of pressure behind the center of mass to stabilize the ring airfoil. Also, slots and holes in the base of the ring airfoil tail can be used to achieve the drag forces. However, this is usually not effective enough to correctly stabilize the projectile without other means and is not the most efficient means of achieving aero dynamic stabilization forces on the ring airfoil.

As the ring airfoil 80 travels through the air a low pressure is created in the duct through it by the comparatively more curved or cambered shape of the airfoil surface on the inside of the duct in comparison with the outside surface. Ring airfoil glider or projectile 80 uses a larger camber or curved shape is employed on the inside of the duct in contrast to the lesser curved or cambered shape on the periphery of the ring airfoil creating a higher drag on the ring airfoil than is usual with the reverse situation of differential curved surface on the outside and inside of the ring or even when used with an asymmetric airfoil This increased drag helps stabilize the projectile along with the gyroscopic spin imparted to it by action of the rifling allowing the projectile to be less prone to curved flight paths and external disruptions such as cross wind and air disturbances The center of pressure along the projectile longitudinal axis is aft of the center of mass and the action of the increased drag in the duct creates an aerodynamic stabilizing force on the projectile as if it has a tail much like an arrow, reducing the traditional ring airfoil technology dependence on spin stabilization in cases where it is launched for gun bores with lesser amounts of twist rate to successfully launch ring airfoil glider projectiles such as the Mk19 machine gun, M203 grenade launcher, Milkor™ launcher, Arwin™ launcher and other preexisting projectile launcher, usually in the 37 mm to 40 mm bore size.

Figure 7:
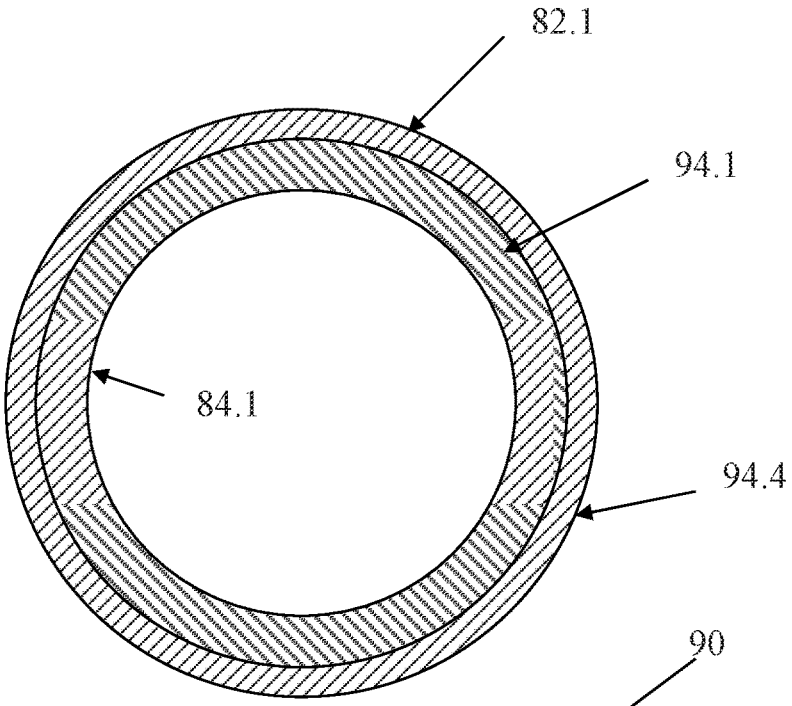
FIG. 7 is a cross hatched representation of the forward projected area of FIG. 6.
Figure 6:
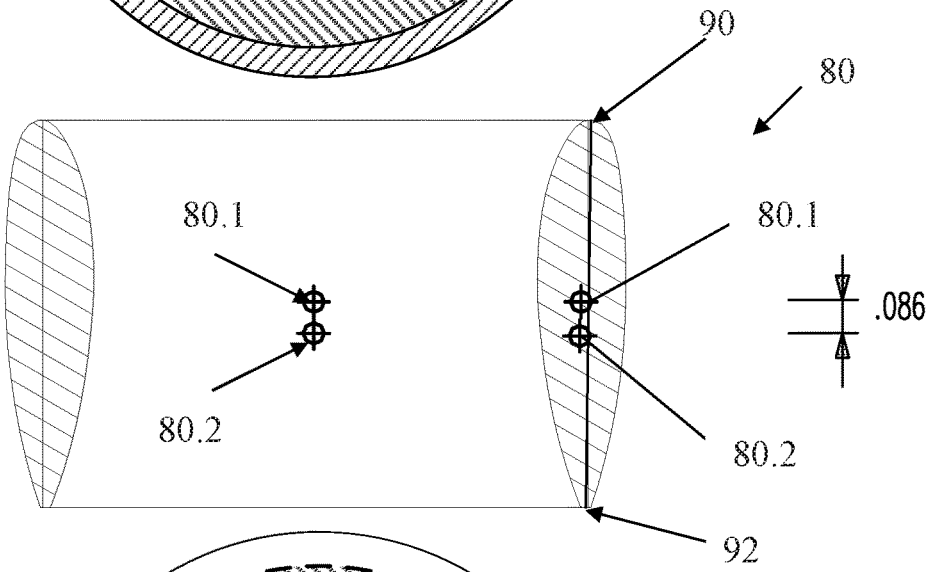
FIG. 6 is a cross sectional and side elevational view of a projectile according to one embodiment of the present invention, showing placement of the center of gravity and center of pressure.
Figure 8:
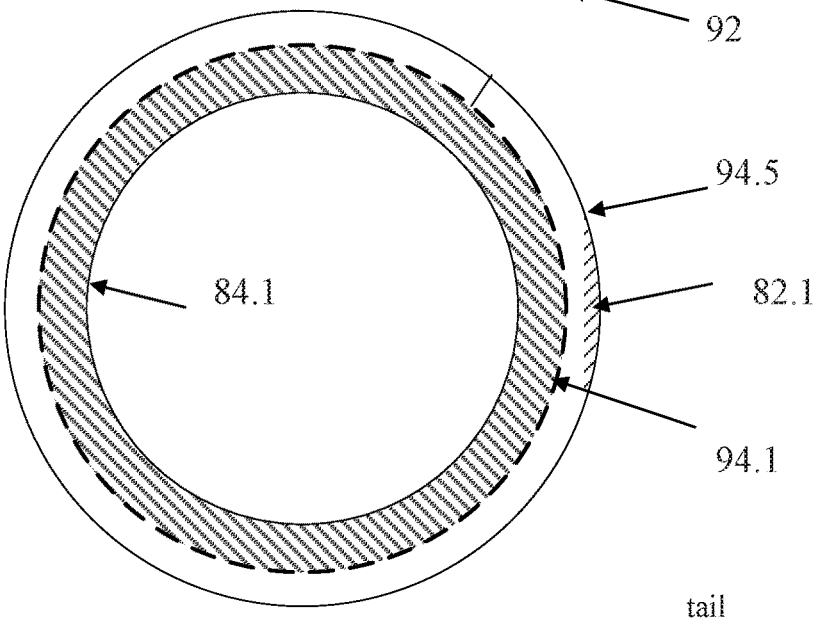
FIG. 8 is a cross hatched representation of the aft projected area of FIG. 6.
Figure 9:
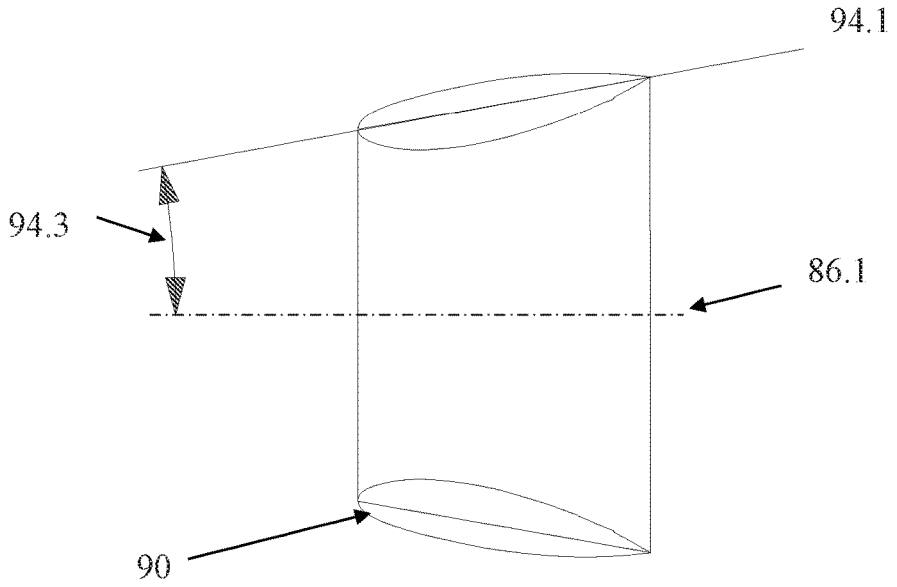
FIG. 9 is a representation of airfoil according to one embodiment of the present invention with a negative angle of attack.
Figure 10:
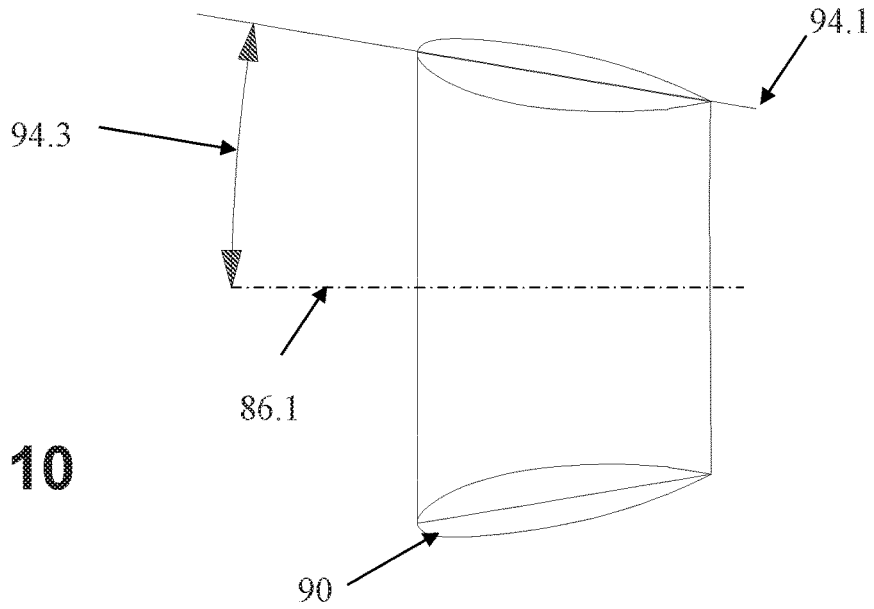
FIG. 10 is a representation of airfoil according to one embodiment of the present invention with a positive angle of attack

The use of a larger camber airfoil shape on the inside of the duct formed by the body of rotation of the airfoil shape to make the ring airfoil in contrast with a comparatively smaller outer camber shape on the periphery of the inventive ring airfoil body is counter intuitive. Subsonic ring airfoils have been of either a tear dropped shape or balanced camber outside to inside, or with the larger cambered wing surface to the outside of the ring airfoil body, and some have even been nothing more than streamlined edged tubes. In the present invention the higher cambered internal duct surface increases drag, which is what ring airfoil technology of the past has steadfastly avoided. Some embodiments of the present invention with a comparatively higher cambered duct surface to the outside of the ring airfoil accept this limitation as to drag to create an aerodynamically stabilized projectile or glider. This is counter intuitive but in application of the configuration of the duct its benefits are made clear. The ratio between the outer and inner annulus area of the airfoil section camber are shown in FIGS. 6-8. Herein, the inner surface towards the duct should be a greater percentage of the total flat plate annular area of the cross section presented to the airflow. This larger portion of the area can be both or either the nose or tail presented areas. The figures show the inlet duct percentage to be approximately 56.5 percent of the nose area and approximately 49.1 percent of the tail area for one embodiment of the invention, with these number corresponding to a approximately a 1 degree positive internal angle of attack of the ring airfoil as to the centerline of the duct. Further, FIG. 7 shows a ratio of outer cambered front projected area to inner cambered front projected area to be less than 1, and in one embodiment to be about 0.8. FIG. 8 shows that the ratio of outer aft projected area to inner cambered after projected area to be about 1, and in one embodiment to be 1.04. In ring airfoil projectile 80, this difference in area ratio results from the angle of attack.

In conventional wings, the positive and negative angle of attack has to do with the angle of the wing to the airstream and are used to increase or decrease lifting forces or even change direction of flight such as a rudder. This applies to flying ring airfoil bodies. However, in ring airfoil technology the present invention is to have not just one but two angles of attack, and utilize the angle to achieve more control and higher aerodynamic stabilizing forces. In the conventional sense the angle of attach that applies to ring airfoils is the angle of attack as to the direction of travel of the ring airfoil body to the centerline of the ring airfoil. This defines the lifting forces applied to the ring airfoil body within the surrounding air stream. This is just like conventional wings. In the present invention, the inventive ring airfoils can have a second angle of attack which applies only to the ring airfoil and the air passing through the duct formed within the rotated section of the ring airfoil. Herein, this is that internal angle of the airfoil section and its duct. The airfoil section or chord line is canted in relation to the centerline of the duct forming an open conical shape towards the inlet, positive internal angle of attack, or closed conical shape towards the inlet, negative internal angle of attack. This defines to a large measure the efficiency or drag that the inventive ring airfoil creates as to any particular airfoil design. Whenever the built in angle of the airfoil, as defined by the chord line, is not parallel with the centerline through the ring airfoil duct increased drag is created by changing the ratio of the inlet to outlet of the duct. If the angle is positive, opening the duct, additional air is forced into the duct. If the angle is negative, closing the duct, less air is forced through the duct. In either case this changes the center of pressure along the length of the airfoil section. It also is effectively like constricting the center of the duct more or less, i.e. increasing camber in the duct side of the airfoil section, or like moving the center of the camber forward and back. About the absolute maximum limit for this internal angle of attach is approximately five degrees from the centerline, usually it is preferred to limit it to about one to 2 degrees. This effect can influence both the location of the center of pressure for a give airfoil section but can also greatly affect the intensity airflow velocity and low pressure in the duct. This is advantageous in creating an aerodynamic stabilizing force on the ring airfoil body, most usually when launched from gun barrels with insufficient rifling pitch to achieve adequate stabilization of the ring airfoil body.

What is commonly understood with airfoils in general is that the center of the camber in the more cambered side of the airfoil section would usually coincide with the center of lowest pressure above the low pressure side of a conventional free wing. But in some embodiments of this invention, airfoil this may not be the case due to the internal angle of the airfoil section with the centerline of the body. A positive angle or negative angle of the chord line to the ring airfoil body centerline both cause the center of pressure on the airfoil section to move towards the tail. This is usually a low pressure not a high pressure in subsonic airfoils. It would only become a positive, above atmospheric pressure, if the speed, opening and constriction in the duct were such to cause a choking effect wherein the airflow would then form a bow wave and travel around the outside of the ring airfoil body. As the internal angle of attack increases, either positive or negative, the low pressure area above the inner camber of the wing or airfoil section moves toward the outlet of the duct. This effectively works like base drag on a conventional projectile or like the base drag associated with a badminton bird with the conical tail.

In FIGS. 11-19, the inventive ring airfoil utilizing both larger airfoil camber on the duct surfaces and internal angle of attack is compared to the effects such internal angles of attach applied to conventionally cambered ring airfoils and symmetric shapes. In one embodiment, there is a ring airfoil with a higher internal camber of the airfoil section in the duct is shown in neutral or zero degrees internal camber along with both positive, more open inlet, and negative more closed inlet, internal angles of attach of five degrees which is approaching the maximum possible without causing flow separations. As it is shown the center of mass or gravity and the center of pressure, lower than atmospheric, pressure in the duct are defined as a ratio of the distance between the center of mass, cM (also referred to herein as the center of gravity or CG), and center of pressure, cP. In the case of negative internal angle of attack, closed inlet, the ratio is 0.14 which translates into a high level of aerodynamic stabilizing force as the cP is behind the cM. In the case of neutral angle of attach the ratio is 0.06 which is much higher than can be achieved from conventionally configured ring airfoils. In the case of the positive angle of attack, more open inlet, the ratio 0.16 is even higher for the same angle of internal angle of attack shown of five degrees than the negative angle. The reason the more open inlet or positive angle of attack has a higher ratio is that more air is swallowed by the duct than in the negative angle version which results in slightly higher duct air velocities for the same forward velocity of the ring airfoil body.

If the internal angle of attach is applied to a tear dropped shaped or balanced camber wing section ring airfoil (FIGS. 17-19) the effect of the stabilization force is either much less than for the inventive high internal to the duct cambered ring airfoil or is actually counterproductive. In the tear dropped shaped ring airfoil with an equal camber of the airfoil section in the duct to the perimeter camber of the ring airfoil body is shown in neutral or zero degrees internal camber along with both positive, more open inlet, and negative more closed inlet, internal angles of attach of five degrees which is approaching the maximum possible without causing flow separations. In the case of negative internal angle of attack, closed inlet, the ratio is 0.017 which with the cM ahead of the cP which provides a very low aero dynamic stabilizing force. In the case of neutral angle of attach the ratio is 0.011 with the cP ahead of the cM which is an unstable state requiring more spin to achieve stabilized flight of so configured ring airfoils. In the case of the positive angle of attack for the same angle of internal angle of attack of five degrees the result is 0.006 with the cP ahead of the cM which is a slightly unstable state.

If the inventive internal angle of attack is applied to a flatter cambered duct surface than the outer perimeter surface shaped wing section ring airfoil the effect of the stabilization force is either much less than for the inventive high internal to the duct cambered ring airfoil or is actually even more counterproductive than for a balance wing section. The flatter cambered internal duct surface shaped ring airfoil body the airfoil section is shown in neutral or zero degrees internal camber along with both positive, more open inlet, and negative more closed inlet, internal angles of attach of five degrees which is approaching the maximum possible without causing flow separations. In the case of negative internal angle of attack, closed inlet, the ratio is 0.037 which with the cM ahead of the cP which provides a low aero dynamic stabilizing force. In the case of neutral angle of attach the ratio is 0.018 with the cP ahead of the cM which is an unstable state requiring more spin to achieve stabilized flight of so configured ring airfoils. In the case of the positive angle of attack for the same angle of internal angle of attack of five degrees the result is 0.024 with the cP ahead of the cM which is also an unstable state.

It is helpful to summarize differences between projectiles of the present invention that are stabilized both aerodynamically and with spin verses projectiles that are only spin stabilized. This −1 type projectile or partially aero dynamically stabilized ring airfoil is significantly different than other conventional or type −2 totally spin stabilized, ring airfoils in general and varies in several ways:

1. The −1 is partly spin stabilized and partly aerodynamically stabilized whereas the type −2 is spin stabilized only.
2. The −1 self corrects erratic flight when launched within its designed operational velocity range.
3. For the same diameter or size, the −1 may be heavier than the −2.
4. The −1 may function over a narrower initial launch velocity range than the −2.

5. The −1 may have a higher drag coefficient compared to the −2.
6. The −1 may have a higher trajectory than the −2.

It should be mentioned increasing spin rate of the projectile or rifling pitch in the barrel could be a solution to increase stability, but would require a new barrel for the Mk19 which would make launching standard ammunition problematic along with increasing the negative stability effects created on the ring airfoil by high spin rates. And, these increased spin means would increase the negative effect of difference in cM and cP location and overall ring airfoil body angle of attack.

Figure 2:
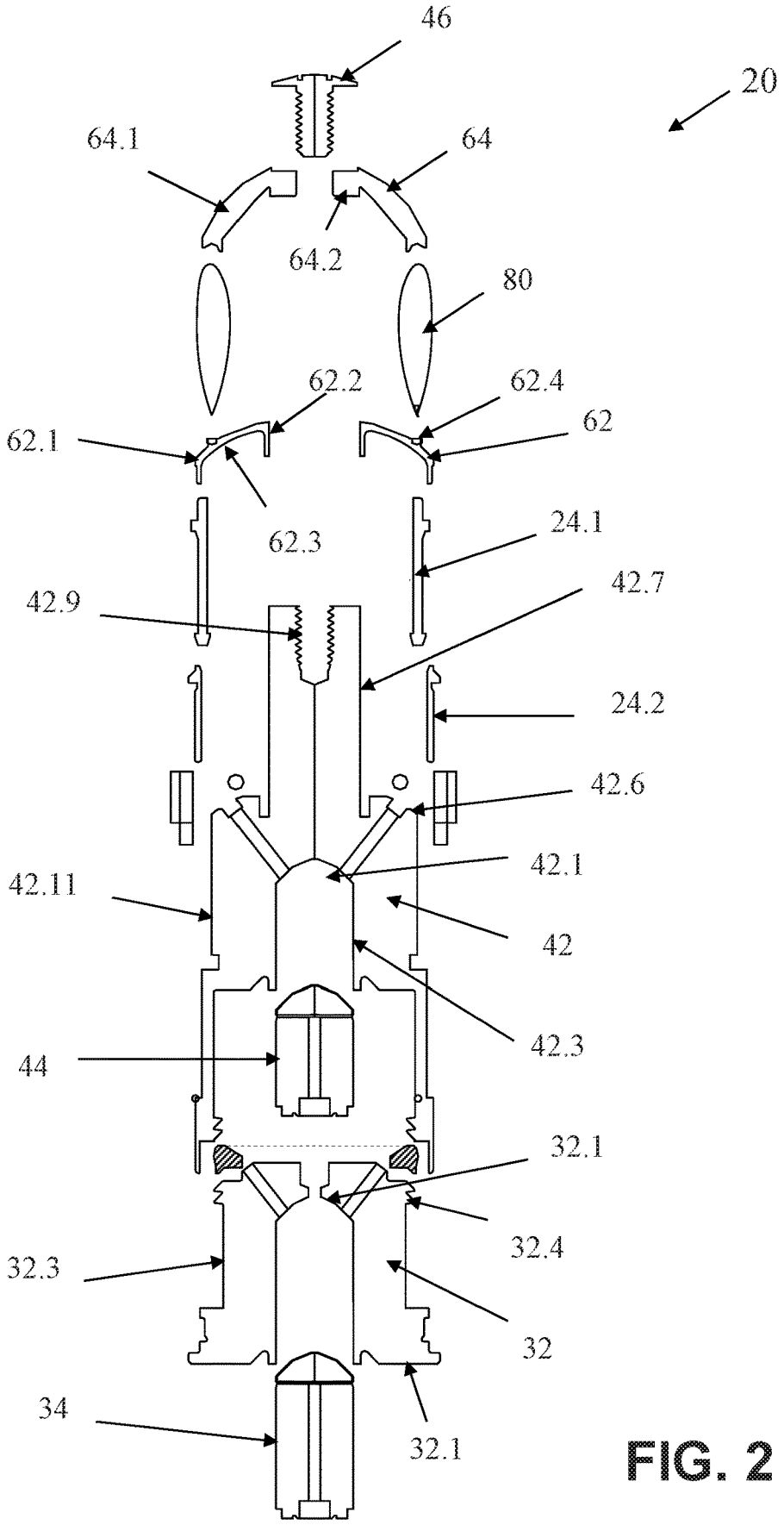
FIG. 2 is an exploded view of the ammunition of FIG. 1.

FIGS. 1 and 2 show cross-sectional and exploded views of a munition 20 according one embodiment of the present invention. Ammunition 20 includes a payload section 60 supported by a launch support assembly 40. Further, a telescoping assembly 30 co-acts with launch assembly 40 to provide a breach block resetting capability for automatic weapons. Ammunition 20 can be fired from any type of gun, including the Mk 19 machine gun, the Mk M203 and Milkor single shot weapons, as well as 37 mm guns.

Telescoping assembly 30 includes a support member 32 that is slidingly received within a pocket of launch support member 42. Telescoping support further includes a pocket 32.3 that receives within it an explosive assembly 34. In one embodiment, explosive assembly 34 includes an initiator 34.1 in fluid communication via a passageway 34.3 within packing 34.2 to an explosive charge 34.4. A resilient seal 36 provides sealing of the exploded charge 34.4 between members 32 and 34 prior to the rearward telescoping of member 32 relative to member 34. Circumferential abutment 32.4 interacts with abutment 42.4 to limit the sliding of member 32 relative to member 42. In some embodiments, telescoping assembly 30 further includes a ball-shaped firing pin 37 that is launched into and thereby causes ignition of initiator 44.1 during firing of ammunition 20. Telescoping assembly 30 is preferably present in those versions of ammunition 20 that are fired from automatic weapons. Some embodiments of the present invention pertain to single shot weapons that do not need the function provided by telescoping assembly 30.

Launch support assembly 40 provides secure mechanical coupling to the firing chamber of a gun, supports payload section 60, slidingly couples to assembly 30 as previously described, and further supports a linkage assembly 24. Linkage assembly 24, as shown in FIGS. 1 and 2, is a sliding link assembly that couples adjacent ammunitions 20 to each other. Linkage assembly includes a seal and retaining member 24.1 that is received on the outer diameter 42.11 of support 42. A link mount 24.2 is slidingly received over the outer diameter of retainer 24.1. A first Link 24.3 is tightly secured to the outer diameter of link mount 24.2, and further receives and retains a captured coupling link 24.4 that couples to another coupling link of an adjacent ammunition 20. Operation of the links, as well as operation of a munition, will be shown in FIGS. 29-34 that follow.

Support member 42 of Launch support assembly 40 further includes within it a pocket 42.3 that receives an explosive assembly 44. Explosive assembly includes an initiator 44.1 that is in fluid communication with an explosive charge 44.4 by way of a central passage 44.3 within packing material 44.2.

Explosive charge 44.4 is placed within a combustion chamber 42.1 of support 42. A plurality of gas release passages 42.5 provide fluid communication of the combusted explosive charge with a plurality of hemispherical balls at the exit of the passage.

In some embodiments, one or both of the combustion chambers 32.1 or 42.1 can include a rupture diaphragm such as a copper disc that is conformally placed between the explosive charge and the chamber defined by corresponding member 32 or 42. This disc contains the explosive gases until they reach sufficient pressure to rupture the disc wall and subsequently release the combusted gases into the corresponding gas passages 32.5 or 42.5.

Extending from one end of support 42 is a rod 42.7 that includes a receptacle for a fastener, such as threaded receptacle 42.9. Support 42 further includes a circumferentially extending shoulder 42.6 located proximate to the end of gas release passages 42.5. A pocket is formed around the base of rod 42.7 between the outer diameter 42.8 of the rod and the inside of shoulder 42.6.

A payload section 60 is received on rod 42.7 and shoulder 42.6 of support member 42. Payload section 60 includes a sabot that is fittingly received on shoulder 42.6. A frangible retainer 64 is received on the distal end of rod 42.7. A ringed airfoil projectile 80 is captured between sabot 62 and retainer 64.

Sabot 62 includes a curving annular middle section located between an inner cylindrical portion 62.2 and an outer cylindrical portion 62.1. The inner face of the annular midsection is received against shoulder 42.6. The inner diameter of cylindrical section 62.2 is in sliding contact with outer diameter 42.8 of rod 42.7. The outer diameter of outer cylindrical portion 62.1 includes an outer most diameter that is in sliding contact with the inner diameter and rifling 22.2 of the barrel 22.1 of a gun 22, as will be shown and described for FIGS. 29-34. Sabot 62 further includes a plurality of circumferentially extending drive features 62.4 that couple to corresponding and complementary driven features of ring airfoil 80.

Retainer 64 includes a center support ring 64.2 that is held on the end of rod 42.7 by a fastener or other coupling means 46. A plurality of outwardly extending and separated petals 64.1 extend from support ring 64.2 a frangible feature such as a notch is preferably located at the connection of a petal to the support ring, and acts as a stress riser during operation. Each petal extends outwardly and aft (aft being defined as the direction toward telescoping assembly 30 and forward being defined as the direction toward payload section 60 and further toward the open end of the gun barrel), and on the aft face of each petal there is a small pocket for receiving within it the leading edge 90 of ring air foil 80. Ring air foil 80 is captured on ammunition 20 between sabot 62 and retainer 64.

Figure 3:
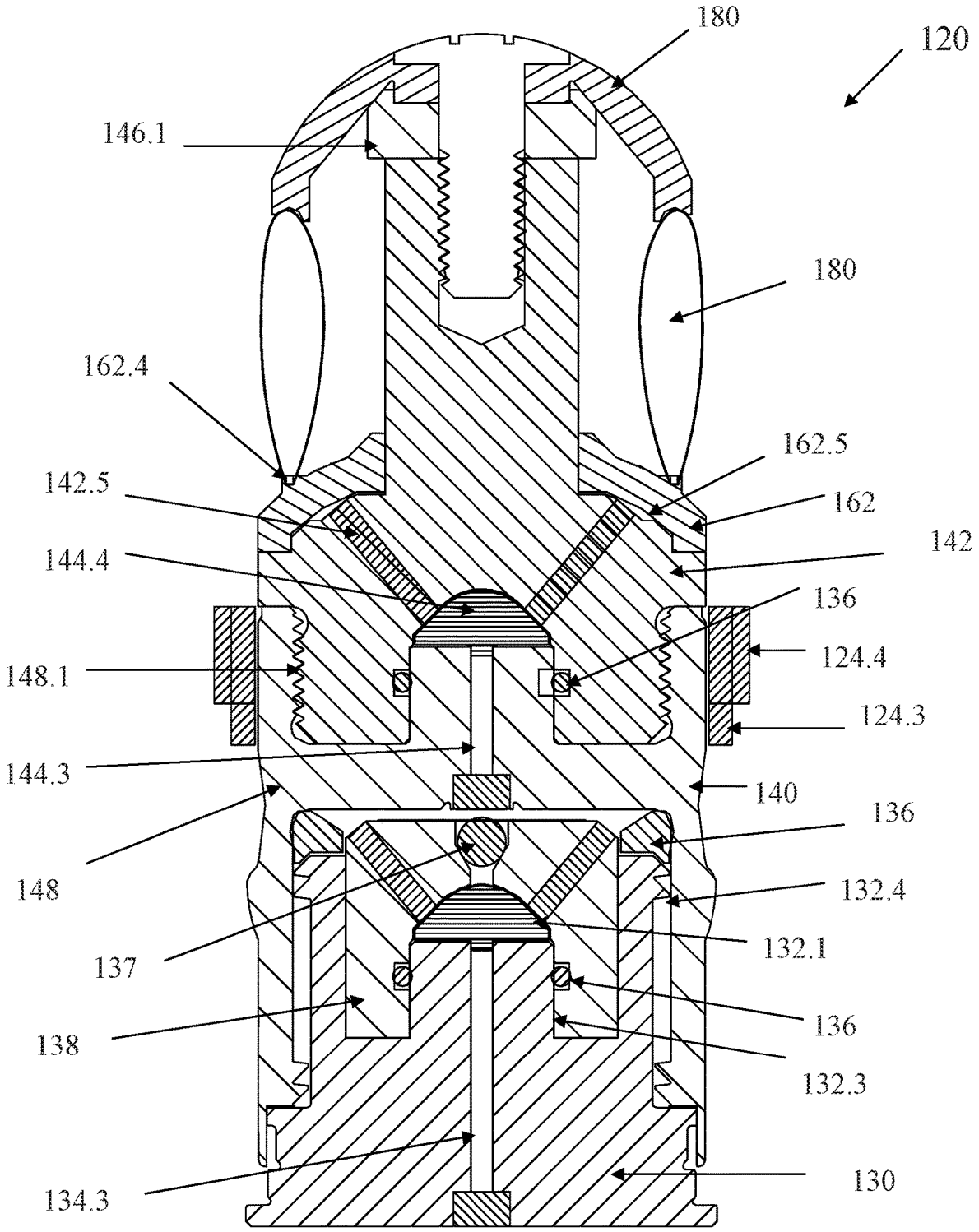
FIG. 3 is a cross sectional elevational view of ammunition according to another embodiment of the present invention.

FIG. 3 is a cross sectional view of a munition 120 according to another embodiment of the present invention. Munition 120 is similar in form, fit and function to munition 20, except for differences that will described.

Telescoping assembly 130 includes an inner support member 138 that is received within an annular pocket of support member 132. Inner support 138 includes the plurality of gas release passages 132.5 that extend from the combustion chamber 132.1 in the outward and forward direction toward the aft face of the inner pocket of outer support member 148. Combustion chamber 132.1 is located in an aft-facing pocket of inner support 138. A forward facing projection 132.3 of support 132 includes the central passage 134.3 that fluidly connects the initiator and the explosive charge, and further replaces the need for packing material.

Launch support assembly 140 includes an outer support member 148 that receives inner support 142. Members 142 and 148 are threadably coupled together at threaded interface 148.1. Outer support 148 further includes an inner cylindrical projection that defines a central passage 144.3 that provides fluid communication from the initiator to explosive charge 144.4. As shown in FIG. 3, munition 120 includes a fixed link assembly coupled to the outer diameter of member 148. First link 124.3 is fixed in place and held by friction against the outer diameter of member 148, and further defines pockets that receive an movable coupling link 124.4. A pair of seals 136 provide sealing of the com busted charge, one seal 136 being used in launch support assembly 140 and another seal 136 being used in telescoping assembly 133. A spacer 146.1 is placed between the end of rod 142.7 and the aft face of support ring 164.2.

Figure 4:
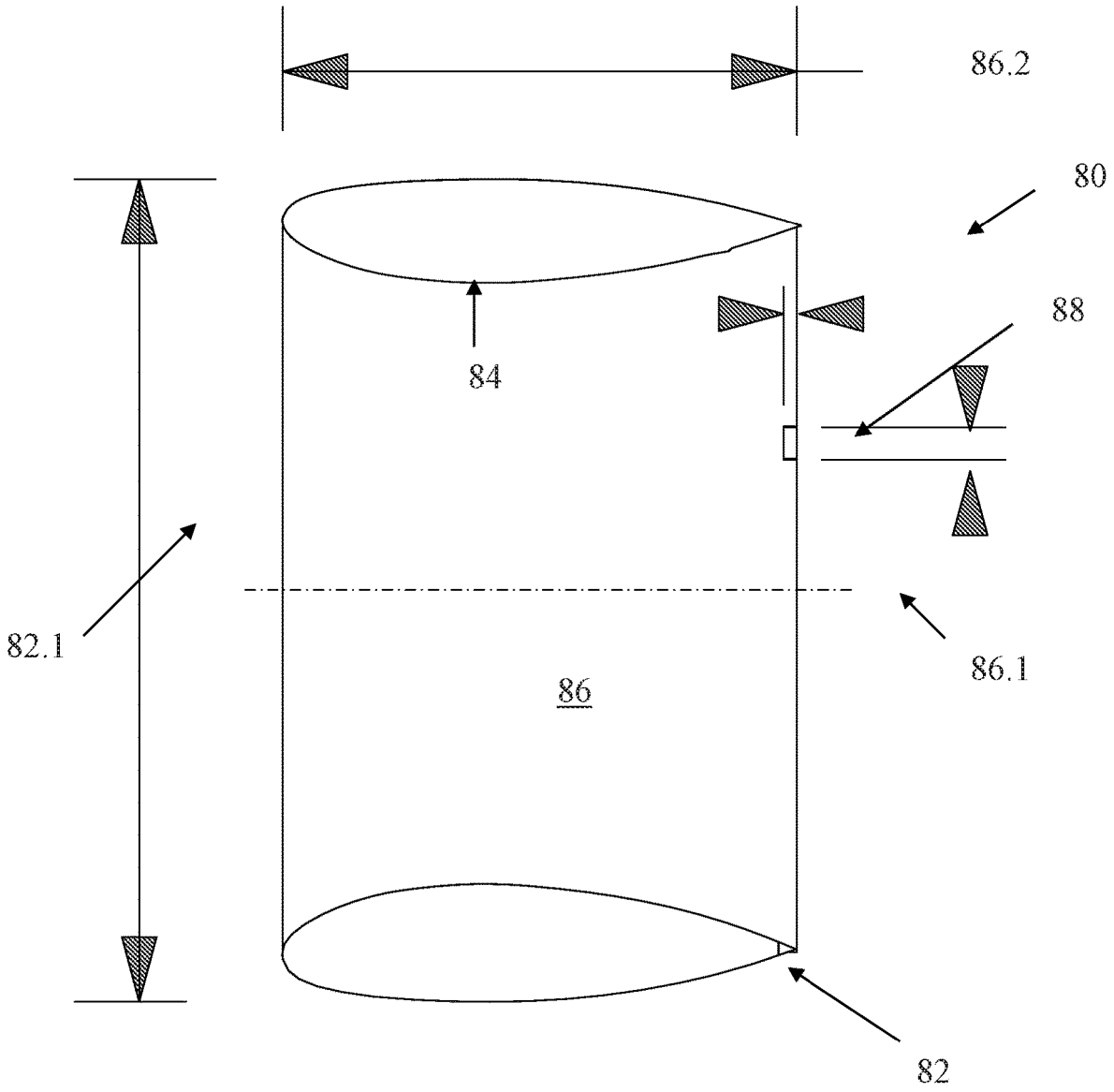
FIG. 4 is a cross sectional and side elevational view of a projectile according to one embodiment of the present invention.

FIGS. 4, 5, and 6 show cross sectional, side elevational views of ring airfoil 80. Airfoil 80 comprises a substantially hollow, annular ring wall. The wall of airfoil 80 has an airfoil section 94 that includes a cambered outer surface 82 and cambered inner surface 84. These inner and outer surfaces 82 and 84, respectively, meet at a substantially blunt leading edge 90, and at a substantially tapered trailing edge 92. The inner surface 84 of airfoil 80 defines a substantially open central aperture 86. Preferably, ring airfoil 80 is a body of revolution formed by rotating airfoil section 94 about central axis 86.1. Ring airfoil 80 has a length 86.2 from leading edge 90 to trailing edge 92, and an outer diameter 82.1 extending across the outermost portion of outer surface 82, and an innermost diameter or throat 86.4 extending across the innermost portion of inner surface 84. In some embodiments, trailing edge 92 includes a plurality of drive features (such as the rectangular cutouts shown in FIG. 4) that mate with complementary features on sabot 62.

Referring to FIG. 5, projectile 80 has an inner surface 84 that is more cambered than outer surface 82. A mean camber line 94.2 is shown superimposed over a chord line 94.1. It can be seen that mean camber line 94.2 extends inward over most of chord line 94.1. Further, in some embodiments, chord line 94.1 has a positive angle of attack 94.3 relative to centerline 86.1, meaning that chord line 94.1 is angled open in the direction of travel of projectile 80.

FIG. 5 further shows how the inner cambered surface further defines three regions of the inner flowpath. The entry to aperture 86 includes a converging inlet section 86.3 in which the area available for flow deceases along axis 86.1. Following this converging inlet is a central throat section 86.4 that defines the minimal flow area along the inner flowpath. After air exits throat 86.4, it flows into a diverging section 86.5 that has a flow area that increases in the direction of flow within central aperture 86.

FIGS. 6, 7, and 8 show a ring airfoil projective 80 according to one embodiment of the present invention, and the forward-facing and aft-facing projected areas. FIG. 7 is a frontal plan view of airfoil 80. The front point of chord line 94.1 is shown as a circle approximately midway within the total annular projected area. Outer diameter 82.1 defines the outermost boundary of the projected area, and inner diameter 84.1 defines the innermost boundary of the projected area. It can be seen that the outermost projected area (from chord line 94.1 to outer diameter 82.1), shown in single cross-hatch is about 43.5 percent of the total area. The innermost cambered surface (from chord line 94.1 to inner diameter 84.1) represents about 56.5 percent of the total projected area. In one embodiment, for a projectile 80 used in a Mk 19 machine gun, outer diameter 82.1 is about 1.6 inches, inner diameter 84.1 is about 1.6 inches, and the total presented forward-facing area is about 0.93 square inches. In this embodiment, the chord line 94.1 has a diameter of about 1.42 inches.

FIG. 8 shows the aft-facing projected area of one embodiment of projectile 80. The rearward projected area 94.1 is apportioned by chord line 94.1 such that the inner cambered surface (from chord line 94.1 to inner diameter 84.1) is about 49 percent. The projected area of the outer cambered surface (from outer diameter 82.1 to chord line 94.1) is about 51 percent. In one embodiment used on the Mk 19 machine gun, the outlet chord diameter 94.1 is about 1.39 inches in diameter.

Center of pressure 80.2. In one embodiment, the distance between the center of pressure and the center of gravity is about 0.09. On this particular embodiment, the overall length 86.2 of projectile 80 from leading edge to trailing edge is about 1 inch, such that the distance between the forward center of gravity and the aft center of pressure is about 9% of the length of projectile 80.

Tables 1 and 2 present data for outer diameter and inner diameter, respectively, related to a programming table of values for a computer numerically controlled machine to fabricate a projectile according to one embodiment of the present invention. In both of these tables, the first column represents the diametrical distance (or twice the radius from the center line), and the second column represents a location along the Z Axis. A representative projectile can be machined from this data. If a cutting tool having a radius of about 0.016 is positioned in accordance with this data, it will have a tangent point of contact on the airfoil surface. In one embodiment, the overall length of the projectile is about 1 inch.

TABLE 1

| Diametral Distance | Axial Location |
|---|---|
| 1.4364 | +.0158 |
| 1.4422 | +.0153 |
| 1.4476 | +.0148 |
| 1.4530 | +.0140 |
| 1.4586 | +.0131 |
| 1.4644 | +.0119 |
| 1.4708 | +.0104 |
| 1.4774 | +.0088 |
| 1.4842 | +.0066 |
| 1.4908 | +.0045 |
| 1.4968 | +.0022 |
| 1.5032 | −.0004 |
| 1.5086 | −.0029 |
| 1.5136 | −.0055 |
| 1.5188 | −.0064 |
| 1.5236 | −.0113 |
| 1.5280 | −.0145 |
| 1.5324 | −.0179 |
| 1.5366 | −.0215 |
| 1.5410 | −.0255 |
| 1.5452 | −.0298 |
| 1.5492 | −.0344 |
| 1.5532 | −.0393 |
| 1.5572 | −.0445 |
| 1.5812 | −.0502 |
| 1.5850 | −.0582 |
| 1.5888 | −.0627 |
| 1.5726 | −.0697 |
| 1.5762 | −.0771 |
| 1.5798 | −.0850 |
| 1.5834 | −.0934 |
| 1.5868 | −.1024 |
| 1.5902 | −.1125 |
| 1.5936 | −.1230 |
| 1.5968 | −.1340 |
| 1.5996 | −.1457 |
| 1.6028 | −.1582 |
| 1.6056 | −.1713 |
| 1.6064 | −.1755 |
| 1.6090 | −.1898 |

TABLE 1-continued

| Diametral Distance | Axial Location |
|---|---|
| 1.6116 | −.2048 |
| 1.6138 | −.2207 |
| 1.6180 | −.2375 |
| 1.6176 | −.2519 |
| 1.6194 | −.2705 |
| 1.6210 | −.2901 |
| 1.6222 | −.3109 |
| 1.6234 | −.3329 |
| 1.6238 | −.3420 |
| 1.6246 | −.3888 |
| 1.6252 | −.3907 |
| 1.6252 | −.4127 |
| 1.6252 | −.4346 |
| 1.6246 | −.4523 |
| 1.6240 | −.4888 |
| 1.6228 | −.4854 |
| 1.6218 | −.4987 |
| 1.6200 | −.5181 |
| 1.6178 | −.5373 |
| 1.6156 | −.5558 |
| 1.6134 | −.5715 |
| 1.6108 | −.5886 |
| 1.6076 | −.6057 |
| 1.6042 | −.6229 |
| 1.5998 | −.6434 |
| 1.5956 | −.6612 |
| 1.5912 | −.6789 |
| 1.5912 | −.6789 |
| 1.5864 | −.6985 |
| 1.5812 | −.7143 |
| 1.5758 | −.7315 |
| 1.5704 | −.7484 |
| 1.5644 | −.7652 |
| 1.5574 | −.7843 |
| 1.5508 | −.8010 |
| 1.5440 | −.8180 |
| 1.5366 | −.8363 |
| 1.5288 | −.8532 |
| 1.5210 | −.8694 |
| 1.5138 | −.8847 |
| 1.5080 | −.8995 |
| 1.4982 | −.9143 |
| 1.4944 | −.9213 |
| 1.4882 | −.9362 |
| 1.4782 | −.9534 |
| 1.4648 | −.9724 |
| 1.4554 | −.9881 |
| 1.4463 | −.1.0028 (off surface for reference of shape only $^{+1}_{-.0}$) |
| 1.4394 | −.1.10136 (off surface for reference of shape only) |

TABLE 2

| Diametral Distance | Axial Location |
|---|---|
| 1.4284 | +.0158 |
| 1.4148 | +.0146 |
| 1.3994 | +.0125 |
| 1.3842 | +.0091 |
| 1.3710 | +.0051 |
| 1.3688 | +.0002 |
| 1.3470 | −.0054 |
| 1.3416 | −.0083 |
| 1.3294 | −.0157 |
| 1.3156 | −.0253 |
| 1.3054 | −.0332 |
| 1.2932 | −.0437 |
| 1.2878 | −.0492 |
| 1.2708 | −.0868 |
| 1.2544 | −.0859 |
| 1.2392 | −.1054 |
| 1.2282 | −.1254 |

TABLE 2-continued

| Diametral Distance | Axial Location |
|---|---|
| 1.2142 | −.1458 |
| 1.2036 | −.1668 |
| 1.1946 | −.1878 |
| 1.1888 | −.2100 |
| 1.1808 | −.2323 |
| 1.1754 | −.2544 |
| 1.1710 | −.2780 |
| 1.1672 | −.2971 |
| 1.1640 | −.3178 |
| 1.1616 | −.3381 |
| 1.1588 | −.3771 |
| 1.1584 | −.3961 |
| 1.1588 | −.4155 |
| 1.1602 | −.4382 |
| 1.1622 | −.4583 |
| 1.1650 | −.4817 |
| 1.1688 | −.5085 |
| 1.1734 | −.5326 |
| 1.1788 | −.5601 |
| 1.1848 | −.5890 |
| 1.1918 | −.6182 |
| 1.1994 | −.6468 |
| 1.2076 | −.6747 |
| 1.2182 | −.7020 |
| 1.2258 | −.7285 |
| 1.2358 | −.7544 |
| 1.2464 | −.7796 |
| 1.2578 | −.8041 |
| 1.2698 | −.8284 |
| 1.2828 | −.8885 |
| 1.2988 | −.8776 |
| 1.3118 | −.9025 |
| 1.3278 | −.9277 |
| 1.3446 | −.9530 |
| 1.3824 | −.9788 |
| 1.3812 | |

Tables 3 and 4 present data for outer diameter and inner diameter, respectively, related to a programming table of values for a computer numerically controlled machine to fabricate a projectile according to another embodiment of the present invention. In both of these tables, the first column represents the diametrical distance (or twice the radius from the center line), and the second column represents a location along the Z Axis. A representative projectile can be machined from this data. If a cutting tool having a radius of about 0.016 is positioned in accordance with this data, it will have a tangent point of contact on the airfoil surface. In one embodiment, the overall length of the projectile is about 1 inch.

TABLE 3

| Diametral Distance | Axial Location |
|---|---|
| 1.4364 | +.0156 |
| 1.4422 | +.0153 |
| 1.4476 | +.0148 |
| 1.4530 | +.0140 |
| 1.4586 | +0131 |
| 1.466 | +0.119 |
| 1.4708 | +.0104 |
| 1.4774 | +.0086 |
| 1.4842 | +.0066 |
| 1.4908 | +.0045 |
| 1.4968 | +.0022 |
| 1.5032 | −.0004 |
| 1.5086 | −.0029 |
| 1.5138 | −.0055 |
| 1.5188 | −.0084 |
| 1.5236 | −.0113 |
| 1.5280 | −.0145 |
| 1.5324 | −.0179 |

TABLE 3-continued

| Diametral Distance | Axial Location |
|---|---|
| 1.5366 | −.0215 |
| 1.5410 | −0.255 |
| 1.5452 | −.0298 |
| 1.5492 | −.0344 |
| 1.5532 | −.0393 |
| 1.5572 | −.0445 |
| 1.5612 | −.0502 |
| 1.5650 | −.0682 |
| 1.5688 | −.0627 |
| 1.5726 | −.0697 |
| 1.5762 | −.0771 |
| 1.5798 | −.0850 |
| 1.5834 | −.0934 |
| 1.5868 | −.1024 |
| 1.5902 | −.1125 |
| 1.5936 | −.1230 |
| 1.5968 | −.1340 |
| 1.5998 | −.1457 |
| 1.6028 | −.1582 |
| 1.6056 | −.1713 |
| 1.6064 | −.1755 |
| 1.6090 | −.1898 |
| 1.6116 | −.2048 |
| 1.6138 | −.2207 |
| 1.6160 | −.2375 |
| 1.6176 | −.2519 |
| 1.6194 | −.2705 |
| 1.6210 | −.2901 |
| 1.6222 | −.3109 |
| 1.6234 | −.3329 |
| 1.6238 | −.3420 |
| 1.6246 | −.3666 |
| 1.6252 | −.3907 |
| 1.6252 | −.4127 |
| 1.6252 | −.4346 |
| 1.6246 | −.4523 |
| 1.6240 | −.4888 |
| 1.6228 | −.4854 |
| 1.6218 | −.4987 |
| 1.6200 | −.5181 |
| 1.6178 | −.5373 |
| 1.6156 | −.5556 |
| 1.6134 | −.5715 |
| 1.6106 | −.5886 |
| 1.6076 | −.6057 |
| 1.6042 | −.6229 |
| 1.5998 | −.6434 |
| 1.5956 | −.6612 |
| 1.5912 | −.6789 |
| 1.5864 | −.6965 |
| 1.5812 | −.7143 |
| 1.5758 | −.7315 |
| 1.5704 | −.7484 |
| 1.5644 | −.7652 |
| 1.5574 | −.7843 |
| 1.5508 | −.8010 |
| 1.5440 | −.8180 |
| 1.5366 | −.8353 |
| 1.5286 | −.8532 |
| 1.5210 | −.8694 |
| 1.5136 | −.8847 |
| 1.5060 | −.8995 |
| 1.4982 | −.9143 |
| 1.4944 | −.9213 |
| 1.4862 | −.9362 |
| 1.4762 | −.9534 |
| 1.4648 | −.9724 |
| 1.4554 | −.9881 |
| 1.4463 | −.1.0028 |
| 1.4394 | −.1.0136 |

TABLE 4

| Diametral Distance | Axial Location |
|---|---|
| 1.3918 | +.0156 |
| 1.3782 | +.0146 |
| 1.3628 | +.0125 |
| 1.3476 | +.0091 |
| 1.3344 | +.0051 |
| 1.3220 | +.0002 |
| 1.3104 | −.0054 |
| 1.3050 | −.0083 |
| 1.2928 | −.0157 |
| 1.2790 | −.0253 |
| 1.2688 | −.0332 |
| 1.2566 | −.0437 |
| 1.2510 | −.0492 |
| 1.2340 | −.0668 |
| 1.2178 | −.0859 |
| 1.2026 | −.1054 |
| 1.1896 | −.1254 |
| 1.1776 | −.1458 |
| 1.1580 | −.1878 |
| 1.1502 | −.2100 |
| 1.1440 | −.2323 |
| 1.1388 | −.2544 |
| 1.1344 | −.2760 |
| 1.1306 | −2971 |
| 1.1274 | −.3178 |
| 1.1250 | −.3381 |
| 1.1222 | −.3771 |
| 1.1218 | −.3961 |
| 1.1222 | −.4155 |
| 1.1236 | −.4362 |
| 1.1256 | −.4583 |
| 1.1284 | −.4817 |
| 1.1322 | −.5065 |
| 1.1368 | −.5326 |
| 1.1422 | −.5601 |
| 1.1482 | −.5890 |
| 1.1552 | −.6182 |
| 1.1628 | −.6468 |
| 1.1710 | −.6747 |
| 1.1796 | −.7020 |
| 1.1890 | −.7285 |
| 1.1990 | −.7544 |
| 1.2098 | −.7796 |
| 1.2210 | −.8041 |
| 1.2330 | −.8284 |
| 1.2462 | −.8685 |
| 1.2602 | −.8776 |
| 1.2752 | −.9025 |
| 1.2910 | −.9277 |
| 1.3080 | −.9530 |
| 1.3258 | −.9786 |
| 1.3446 | −1.007 |

It has been determined during development of projectiles 80 that it is helpful to fabricate the projectiles accurately, so that the center of pressure is located aft of the center of gravity. For projectiles that are machined with a tool on a lathe, for example, it is preferred that the overall finish of the projectile be smooth, with little or no projections or irregularities along the blunt leading edge, especially near the stagnation point of the airfoil. Similar, for those projectiles that are cast in a die, it is preferred that the split line of the die no be located along the blunt leading edge, and especially not near the stagnation point of the leading edge. In fabricating multiple piece dies, it is preferred that the die splitlines be located along the throat or diverging sections of the airfoil.

With regards to machined airfoils, one embodiment of the present invention pertains to a machining method that generates little or no surface irregularities along the blunt leading edge. In this method, a projectile blank is cut from a cylindrical supply of stock material, delrin or Noryl plastic material. The center and outside of the projectile are roughed out, preferably on a CNC lathe.

For the finishing pass of the lathe, the roughed part of the projectile is located in the spindle and the base of the projectile blank is clamped in the chuck jaws. One internal boring bar is used to finish machine the outside of the projectile from front to back.

Then, the tool is retracted and the lathe spindle is stopped. Then, the spindle is reversed and the same tool with the same offset is called up in the computer memory of the CNC lathe. Without changing either the tool or the offset, the inside of the semi-finished projectile is machined, leaving a thin attachment at the base of the trailing edge where it attaches to the base of the blank. The tool is then retracted and the spindle is stopped. Subsequently, the finished projectile is cut from the base, the drive features 88 are slotted in a mill, the projectile is deburred on a lathe or with a media tumbler.

Figure 11:
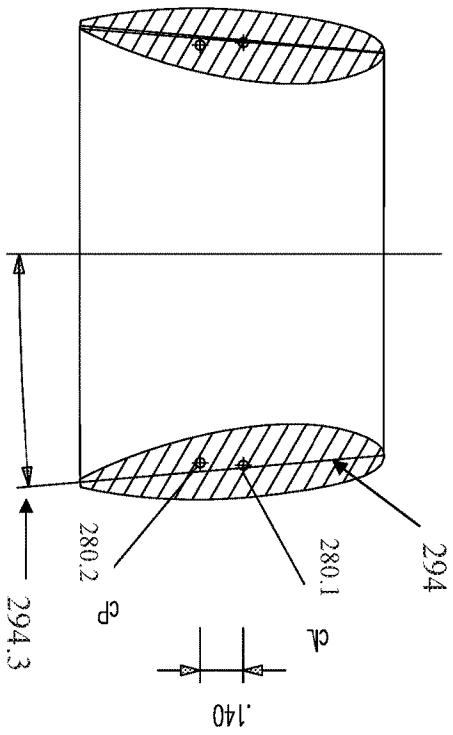
FIG. 11 is a cross sectional view of a projectile having a more cambered inner surface and a negative angle of attack.
Figure 12:
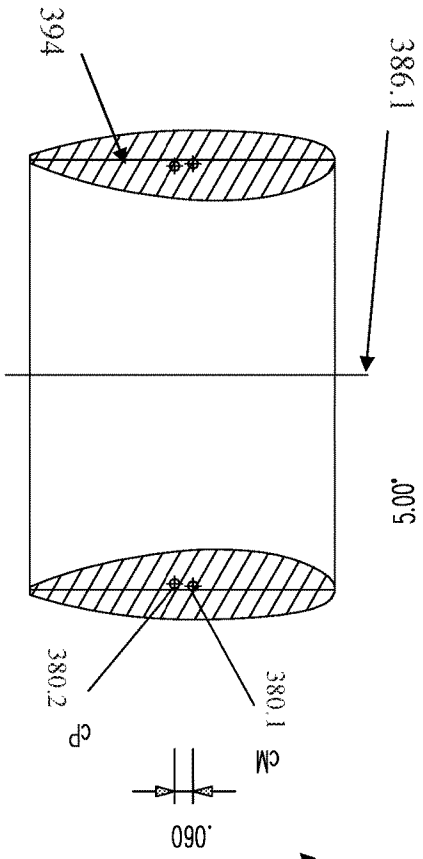
FIG. 12 is a cross sectional view of a projectile having a more cambered inner surface and a neutral angle of attack.
Figure 13:
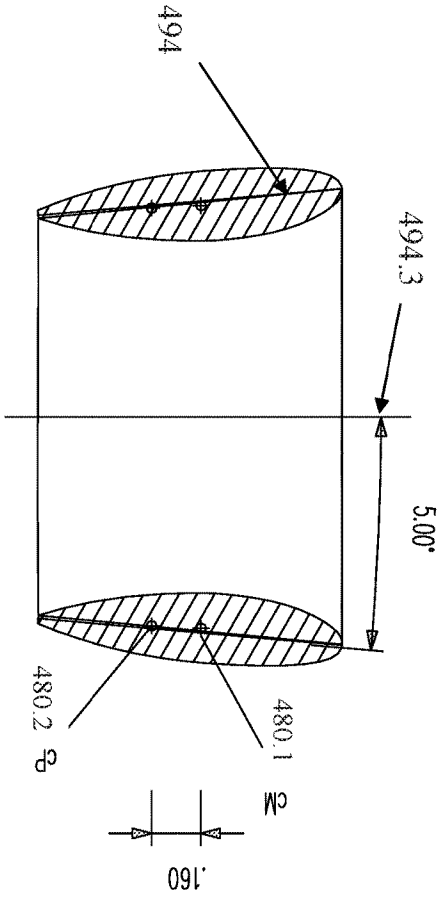
FIG. 13 is a cross sectional view of a projectile having a more cambered inner surface and a positive angle of attack.

FIGS. 11, 12 and 13 are cross sectional views of airfoils having inner surfaces that are more cambered than the outer surfaces. FIG. 11 shows an airfoil 280 having a negative angle of attack (negative meaning that the chord line 294 are angled such that they meet in front of projectile 80). FIG. 12 shows a projectile 380 in which the chord lines 394 are substantially parallel with center line 386.1. FIG. 13 shows a projectile 480 in which the chord lines 494 have a positive angle of attack relative to the forward direction of projectile 480, such that the chord lines intersect behind projectile 480.

Figure 14:
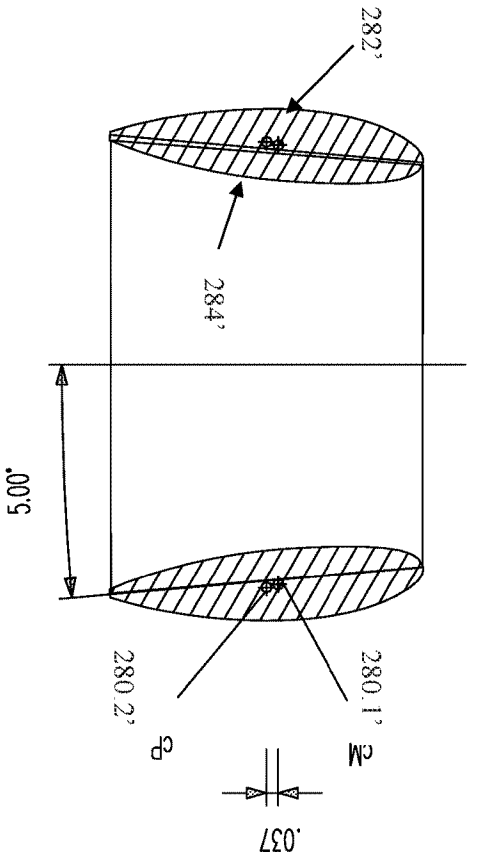
FIG. 14 is a cross sectional view of a projectile having a more cambered outer surface and a negative angle of attack.
Figure 15:
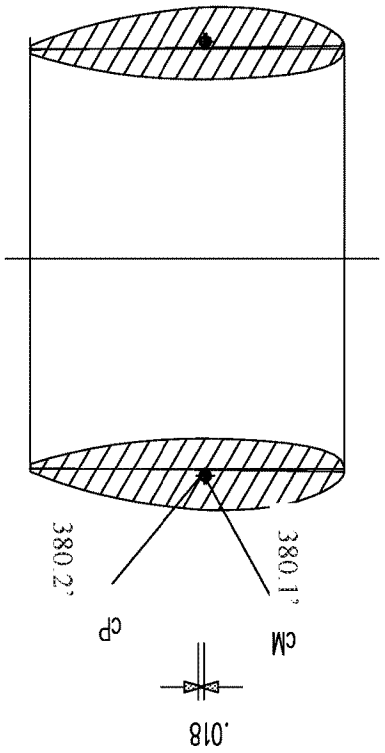
FIG. 15 is a cross sectional view of a projectile having a more cambered outer surface and a neutral angle of attack.
Figure 16:
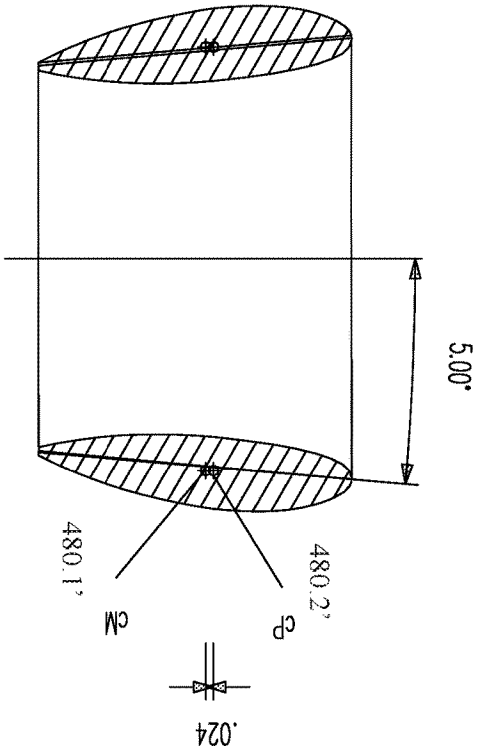
FIG. 16 is a cross sectional view of a projectile having a more cambered outer surface and a positive angle of attack.

FIGS. 14, 15 and 16 are cross sectional views of airfoils having outer surfaces that are more cambered than the inner surfaces. FIG. 14 shows an airfoil 280' having a negative angle of attack (negative meaning that the chord line 294' are angled such that they meet in front of projectile 80'). FIG. 15 shows a projectile 380' in which the chord lines 394 are substantially parallel with center line 386.1'. FIG. 16 shows a projectile 480' in which the chord lines 494' have a positive angle of attack relative to the forward direction of projectile 480', such that the chord lines intersect behind projectile 480'.

Figure 17:
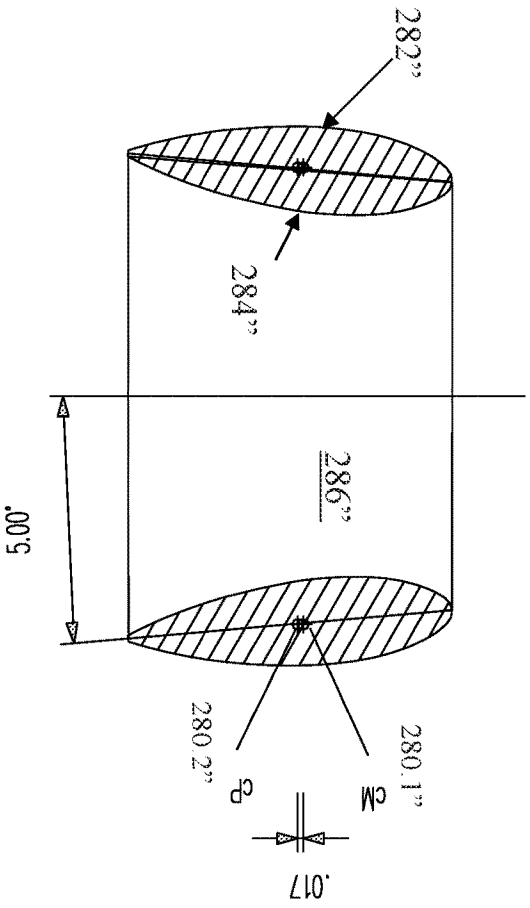
FIG. 17 is a cross sectional view of a projectile in which both surfaces are equally cambered and a negative angle of attack.
Figure 18:
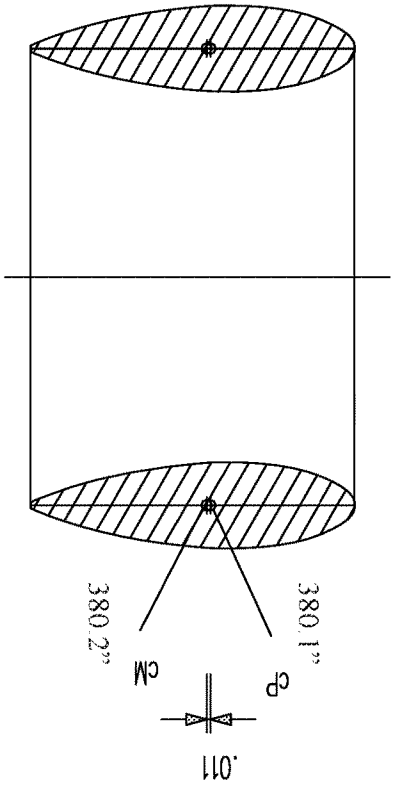
FIG. 18 is a cross sectional view of a projectile in which both surfaces are equally cambered and a neutral angle of attack.
Figure 19:
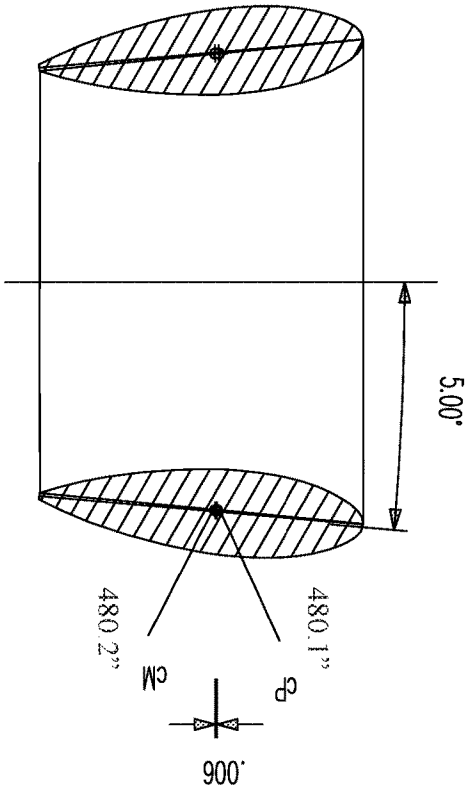
FIG. 19 is a cross sectional view of a projectile in which both surfaces are equally cambered and a positive angle of attack.

FIGS. 17, 18 and 19 are cross sectional views of airfoils that are symmetrical or "teardrop" shaped. FIG. 17 shows an airfoil 280" having a negative angle of attack (negative meaning that the chord line 294" are angled such that they meet in front of projectile 80"). FIG. 18 shows a projectile 380" in which the chord lines 394" are substantially parallel with center line 386.1". FIG. 19 shows a projectile 480" in which the chord lines 494" have a positive angle of attack relative to the forward direction of projectile 480", such that the chord lines intersect behind projectile 480".

Referring again to FIGS. 11, 12, and 13, in each of these three projectiles 280, 380, and 480, it can be seen that the center of gravity (280.1. 380.1, and 480.1, respectively) are located in front of the respective centers of pressure (280.2, 380.2, and 480.2). For the projectiles shown, the distance between the center of pressure and center of gravity ranges from a ratio of projectile length of about 0.05 to about 0.17. In each case, having the center of pressure aft of the center of gravity provides aerodynamic stability to the projectile as it flies.

As can be seen in FIGS. 14, 15, and 16, a projectile having the outer surface more cambered than the inner surface can be adversely affected by changes in angle of attack. For projectile 280', the center of pressure is located aft of the center of gravity by a length ratio of about 0.04, and should thereby result in aerodynamic stability. However, projectile 380 with little or no angle of attack shows that the center of mass is very close to the center of pressure, separated by a length ratio of about 0.02. Therefore, projectile 380' would be expected to have less aerodynamic stability than projectile 280'. As can be seen in FIG. 16 a positive angle of attack can result in a forward shifting of the center of pressure 480.2', such that it is in front of center of gravity for 480.1' by a length ratio of about 0.02. Therefore, projectile 480' may have reduced aerodynamic stability, or even be aerodynamically unstable, with a commensurate error in the accuracy of the fired projectile. A comparison of FIGS. 11, 12, and 13 with FIGS. 14, 15, and 16 shows that having an inner airfoil surface that is more cambered than the outer airfoil surface results in increased stability throughout a range of angles of attack. Further, although this trend is shown in terms of angle of attack, it is an equally applicable trend with regards to errors in machining. Projectiles having inner surfaces that are more cambered than the outer surfaces should generally result in more stabile flight within a family of projectiles having a range of surface errors due to inaccuracies in machining or casting of the projectile.

FIGS. 17, 18, and 19 show the effect of angle of attack on symmetrical airfoils, in which the camber the inner surface is substantially the same as the camber the outer surface. FIG. 17 shows a projectile 280" in which the center of mass is located forward of the center of pressure by a length ratio of about 0.02. FIGS. 18 and 19 show projectiles 380" and 480" in which the centers of pressure 380.2" and 480.2", respectively, are forward of or coincident with the corresponding center of gravity 380.1" and 480.1". FIG. 17 shows that a symmetric or teardrop shaped airfoil can be made to have positive aerodynamic stability by designing the projectile to have a negative angle of attack. However, a limiting aspect of the negative angle of attack could be separation of the airflow within the diverging section of the inner channel 286".

Figure 20:
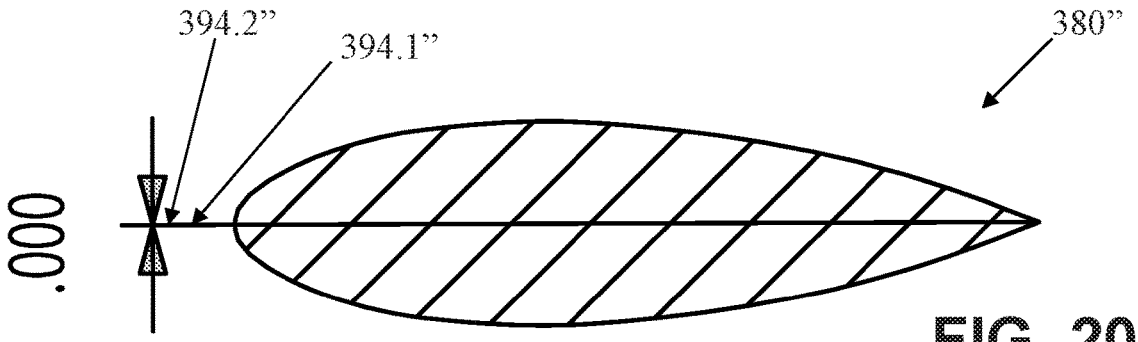
FIG. 20 shows the airfoil shape of FIG. 18.
Figure 21:
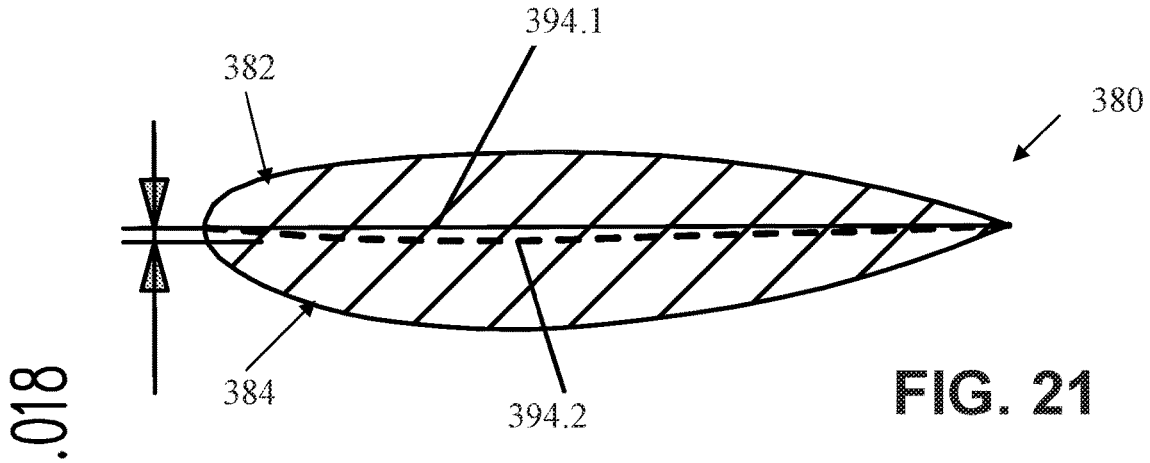
FIG. 21 shows the airfoil shape of FIG. 12.
Figure 22:
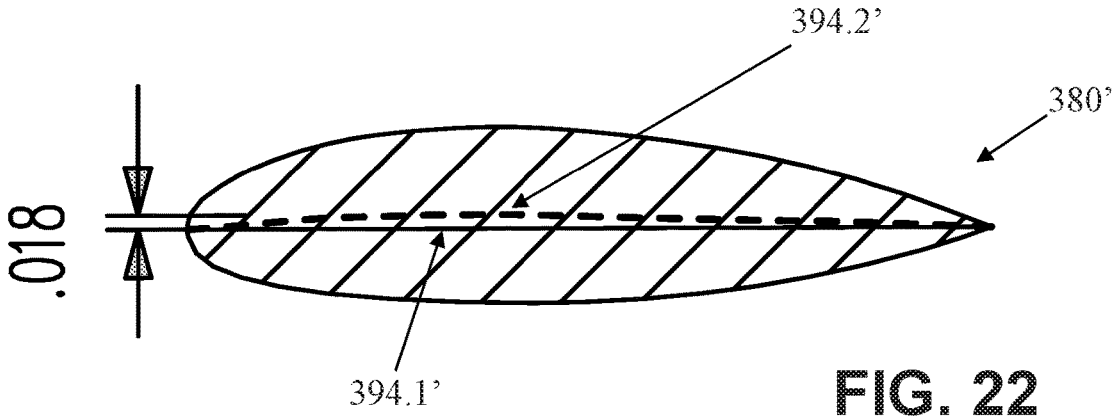
FIG. 22 shows the airfoil shape of FIG. 15.

FIGS. 20, 21, and 22 compare camber lines of the airfoil shapes of projectiles 380, 380', 380". With regards to FIG. 20, projectile 380" has a symmetrical, tear drop shape, such that main camber line is coincident with chord line 394.1". For airfoil 380' shown in FIG. 22, in which the outer surface of the airfoil is more cambered than the inner surface, it can be seen that mean camber line 394.2' is located generally outward of chord line 394.1'. With regards to FIG. 21, projectile 380 includes an inner surface 384 that is more cambered than outer surface 382. It can be seen that mean camber line 394.2 is generally inward (i.e., located closer to the central axis) of chord line 394.1. Note that the airfoil section of projectile 380 has the chord line that is generally parallel to the corresponding center line 386.1 of the projectile, and therefore has little or no angle of attack.

It can be seen that providing either a positive or negative angle of attack can move the mean camber line relative to relative to the chord line. For example, with a positive angle of attack, the forward most portion of the mean camber line would cross over the chord line and act the leading edge, could be located outward (i.e., further from the central line than the chord line). Further, applying negative angle of attack to airfoil 380 can result in the aft most portion of the camber line being located outward of the chord line. However, in both of these cases, the camber line in the central part of the airfoil section (such as within the throat section 386.4) is still located in ward of the chord line. It is believed that this may be one o the reasons why an airfoil section more cambered on the inner surface than on the outer surface has increased aerodynamic stability than other airfoil shapes, especially when taking into account angle of attack and machining tolerances.

Figure 23:
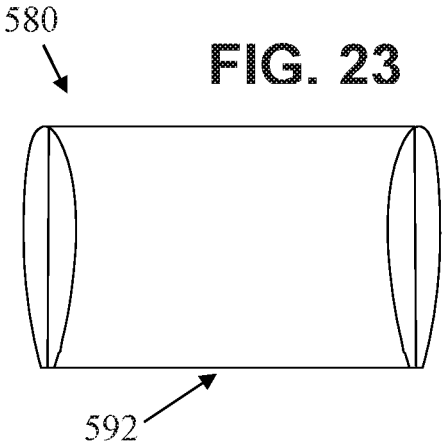
FIG. 23 is a cross sectional and elevated view of a projectile according to another embodiment of the present invention with increased trailing edge drag.

FIGS. 23-28 show additional aerodynamic features for moving the center of pressure aft of the center of gravity for increased aerodynamic stability. FIG. 23 shows a projectile 580 that includes a squared off or otherwise blunt trailing edge 592. By removing the taper at the trailing edge, there is separation of the inner and outer flows from the airfoil surfaces, with possible introduction of recirculating pockets of air in the area aft of the blunt end of the airfoil shape. Such drag is often referred to as "boat tail" drag. In projectile 580, as well as the projectiles shown in FIGS. 24-28, the increased drag occurs at the end of the flowpath. Since the converging and throat area have unchanged shapes, the net effect is to move the center of pressure aft.

Figure 24:
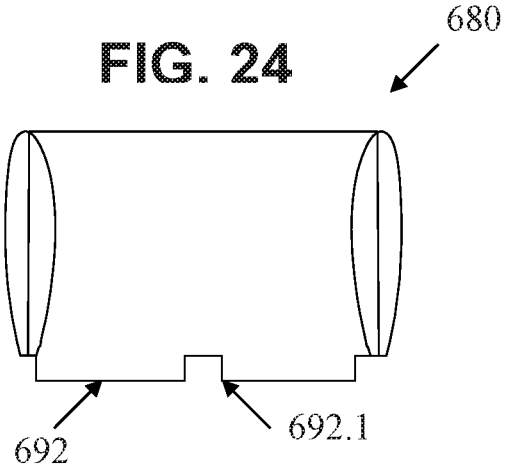
FIG. 24 is a cross sectional and elevated view of a projectile according to another embodiment of the present invention with increased trailing edge drag.
Figure 25:
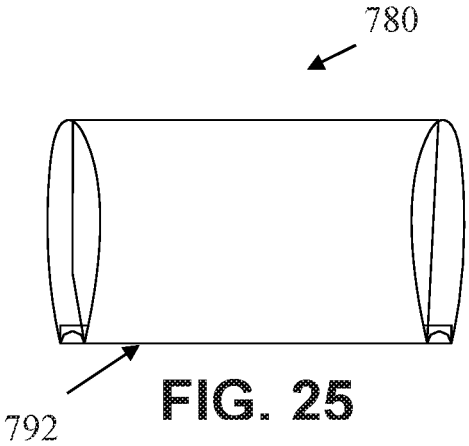
FIG. 25 is a cross sectional and elevated view of a projectile according to another embodiment of the present invention with increased trailing edge drag.

FIG. 24 shows a projectile 680 in which a substantially cylindrical wall extends aft of a blunt trailing edge. Further, one or more notches 692.1 (which may or may not be used for receiving rotational energy from the sabot are made large enough to be a significant aerodynamic disturbance. FIG. 25 shows a projectile 780 having a trailing edge that is inwardly concave such that there must be separation of the airflow as the inner and outer surfaces change direction and double back to form the concave pockets.

Figure 26:
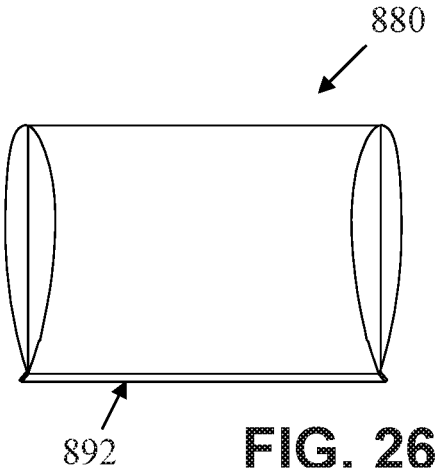
FIG. 26 is a cross sectional and elevated view of a projectile according to another embodiment of the present invention with increased trailing edge drag.
Figure 27:
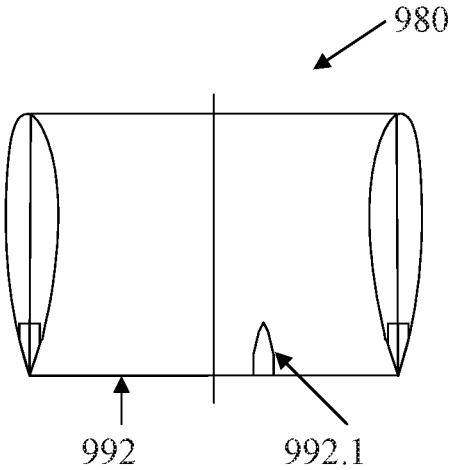
FIG. 27 is a cross sectional and elevated view of a projectile according to another embodiment of the present invention with increased trailing edge drag.
Figure 28:
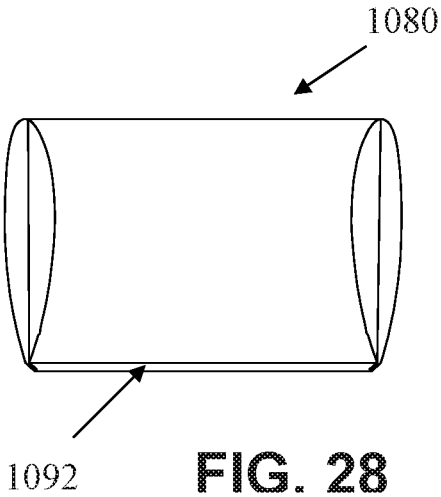
FIG. 28 is a cross sectional and elevated view of a projectile according to another embodiment of the present invention with increased trailing edge drag.

FIG. 27 shows a projectile 980 having a trailing edge 992 with a plurality of circumferential pointed cutouts 992.1, which may or may not be used to impart rotational energy from sabot 962 to projectile 980. It can be seen that projectile 980 still incorporates a substantially tapered edge 992. In one embodiment, pockets 992.1 project sufficiently far forward to impact air that would otherwise flow smoothly within diverging section 986.5. FIGS. 26 and 28 show projectiles 880 and 1080, respectively, each of which incorporates substantially tapered trailing edges. Projectile 880 further includes a lip 892 that extends from the meeting of the inner and outer surfaces of the airfoil in a divergent direction, and which would act as a spoiler for air flowing over the outer surfaces of the airfoil. Projectile 1080 includes a lip 1092 that extends from the substantially tapered trailing edge in a converging direction, such that it would substantially change direction for air flowing over the inner surface of the airfoil 1094.

Figure 35:
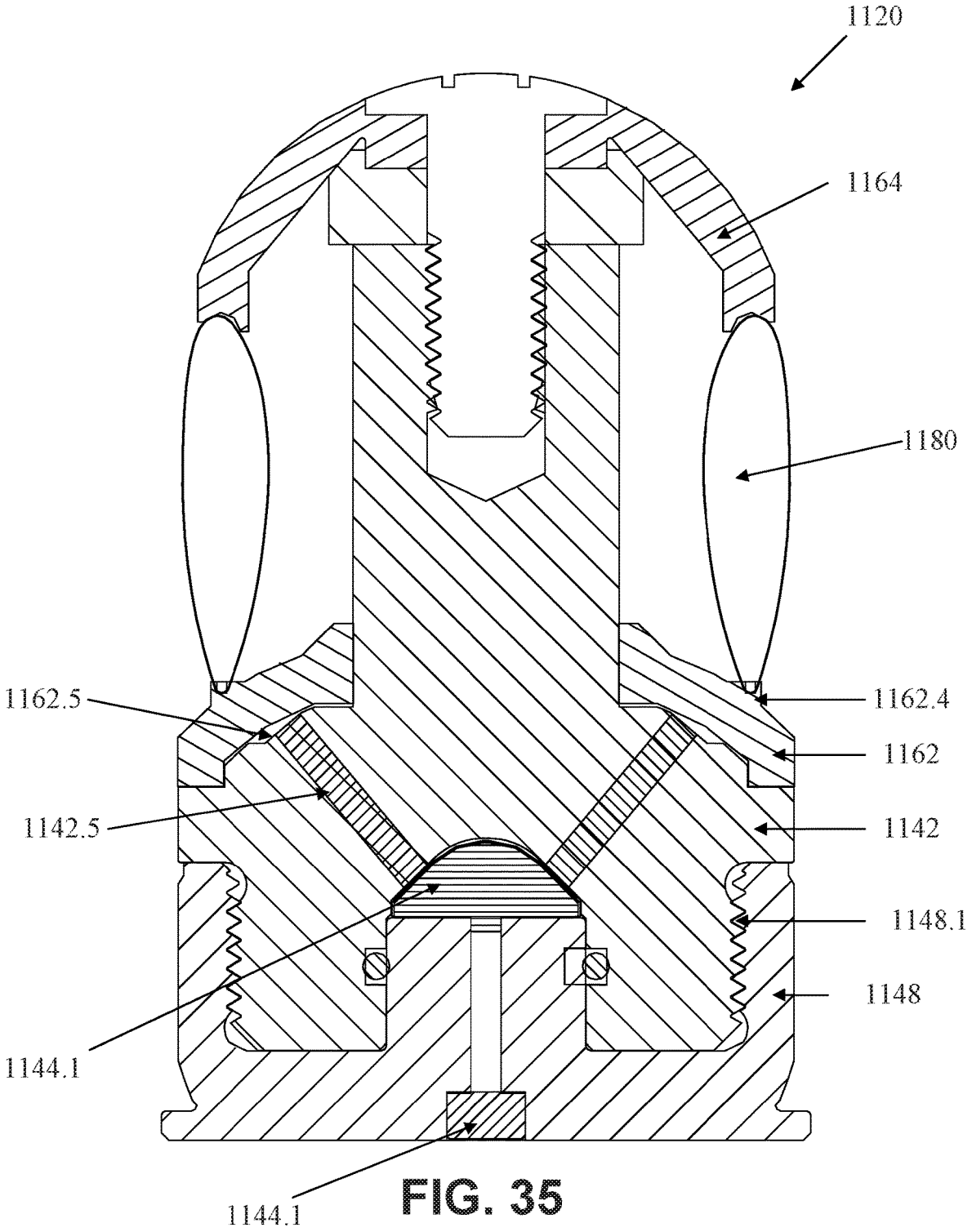
FIG. 35 is a cross sectional elevation view of ammunition according to another embodiment of the present invention.

FIG. 35 is a cross sectional view of a munition 1120 such as the type that can be fired a single shot weapon such as a M203 grenade launcher or Milkor gun. Munition 1120 is substantially similar to munition 120, except that outer member 1148 is modified to account for the single shot nature of the intended weapon. Munition 1120 does not include any telescopic section, since this munition is hand loaded.

FIG. 36 shows a portion of a munition 1220 having a modified method of imparting rotational energy to projectile 1280. Munition 1220 includes a support member 1242 having a threaded or rifled feature 1242.12 on the outer diameter 1242.8 of rod 1242.7. Rifling 1242.12 coacts with the inner diameter 1262.3 of sabot 1262, such that when explosive pressure flows into chamber 1262.5 to push sabot 1262 forward that sabot 1262 spins as a result of rifling 1242.12. A munition 1220, outer diameter 1262.1 of sabot 1262 may contact the inner diameter of the gun barrel, but not a sufficient amount to be spun by any rifling on the inside of the gun barrel. Further, in those embodiments in which munition 1220 is shot in a smooth bore gun barrel, outer diameter 1262.1 forms a gas-discouraging seal so as to maintain pressure within chamber 1262.5.

The following is a description of the firing of ammunition as shown in FIGS. 29-34.

Upon being on the bolt face in the ready battery position, latched and ready to be fired, the trigger is pulled.

The bolt travels forward until the firing pin 22.4 is released, about 1" from the breech face 22.3.

The pin strikes the aft telescoping charges primer initiating the propellant; simultaneously an initiation ball 37 is propelled forward to a primer 34.1 for the forward payload propelling charge, and the expanding gas reacts against the telescoping piston to open the action and auto load function the gun.

The forward payload propelling charge expands against the sabot/pusher 62 pushing it forward while fracturing the projectile retainer 64 along one or more separation groove(s) on the central hub of the retainer releasing the sabot and projectile assembly for forward travel.

The sealing and rotating band on the sabot seals the propelling gas from the action at the forcing cone of the chamber.

The sabot/projectile assembly 160 is pushed along the bore on the center guide mandrill, throughout the launch sequence.

The sabot/projectile assembly travels down the bore to the end of the guide mandrill having spin imparted to the assembly by the action of rifling in the gun bore rotating the sabot which transfers the rotation by the action of drive dogs on its forward face engaging slots in the tail of the ring airfoil projectile.

As the sabot leaves the mandrill the propelling gas are vented down the center of the sabot d own the bore ahead of the sabot I projectile assembly, protecting the ring airfoil projectile, from disturbance by the gas, at which point the maximum velocity is achieved for both the sabot and projectile.

The sabot immediately begins to decelerate due to friction with the bore this causes the projectile to separate, as it has no contact with the bore and little friction retarding its passage down the bore.

The projectile rides a turbulent boundary layer of air between its outer diameter and the bore guiding and centering it until it exits the muzzle, the sabot exits the muzzle at greatly reduced energy, whereupon, the ring airfoil is free to fly towards the target.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A munition for a weapon, comprising:

a ring airfoil projectile adapted and configured for explosive release from a weapon, said projectile including a wall surrounding an inner flowpath and a centerline, the wall being symmetric about the centerline, the wall having an outer surface, an inner surface defining the boundary of the inner flowpath, and a cross-sectional shape, the inner surface of the cross-sectional shape being more cambered than the outer surface of the cross-sectional shape.

2. The munition of claim 1 wherein the inner flowpath is substantially unobstructed.

3. The munition of claim 1 wherein the inner surface smoothly and continuously curves from a leading edge to a trailing edge.

4. The munition of claim 1 wherein the cross sectional shape has a mean camber line and a chord line and the mean camber line is located inward of the chord line.

5. The munition of claim 1 wherein said projectile has a center of gravity, said projectile has an aerodynamic center of pressure, and the center of pressure is behind the center of gravity.

6. The munition of claim 1 wherein the cross-sectional shape has a chord line and the chord line is angled relative to the centerline such that rotation of the chord line about the centerline defines a conical surface having a vertex point aft of the trailing edge of the projectile.

7. The munition of claim 1 wherein the projectile has an outer diameter greater than about 35 mm.

8. The munition of claim 1 wherein the projectile has a leading edge and a trailing edge with a distance therebetween of more than about 20 mm.

9. The munition of claim 1 wherein the projectile has a mass of more than about 5 grams.

10. The munition of claim 1 wherein said projectile has a length from a leading edge to a trailing edge and a maximum outer diameter, and the ratio of the length to the diameter is greater than about 0.44 and less than about 1.

11. The munition of claim 1 wherein the airfoil has a chord line and the airfoil is asymmetric about the chord line.

12. The munition of claim 1 wherein the airfoil has a chord line and the airfoil is symmetric about the chord line.

13. The munition of claim 1 wherein the inner flow path has a minimum diameter, and the minimum diameter is located between the leading edge and the trailing edge.

14. A munition for a weapon, comprising:

a ring airfoil projectile including a wall surrounding an inner flowpath and a centerline, the wall being symmetric about the centerline, the wall having an outer surface, an inner surface defining the boundary of the inner flowpath, and a cross-sectional shape, the inner surface of the cross-sectional shape being more cambered than the outer surface of the cross-sectional shape ;

a support member for positioning the projectile within the weapon, and a source of pressurized gas for propelling the projectile; wherein release of said source propels said projectile out the weapon.

15. The munition of claim 14 wherein the projectile has a mass for more than about 5 grams and less than about 20 grams.

16. The munition of claim 14 wherein the weapon is rifled, and the rifling spins the projectile at more than about 1000 rpm and less than about 8000 rpm.

17. The munition of claim 14 wherein the projectile is fabricated from Delrin or Noryl.

18. The munition of claim 14 wherein the airfoil shape has a leading edge and a trailing edge and the inner surface smoothly and continuously curves from the leading edge to the trailing edge.

19. The munition of claim 14 wherein the cross sectional shape is an airfoil having a mean camber line and the mean camber line is located inward of the chord line.

20. The munition of claim 14 wherein said projectile has a center of gravity, said projectile has an aerodynamic center of pressure, and the center of pressure is behind the center of gravity.

21. The munition of claim 14 wherein the cross sectional shape is an airfoil having a chord line and the chord line is angled relative to the centerline such that rotation of the chord line about the centerline defines a conical surface having a vertex point aft of the trailing edge of the projectile.

22. The munition of claim 14 wherein the projectile has an outer diameter greater than about 35 mm.

23. The munition of claim 14 wherein the projectile has a leading edge and a trailing edge with a distance therebetween of more than about 20 mm.

24. The munition of claim 14 wherein the projectile has a mass of more than about 5 grams.

25. The munition of claim 14 wherein said projectile has a length from a leading edge to a trailing edge and a maximum outer diameter, and the ratio of the length to the diameter is greater than about 0.44 and less than about 1.

26. The munition of claim 14 wherein the cross sectional shape is an airfoil having a chord line and the airfoil is asymmetric about the chord line.

27. The munition of claim 14 wherein the cross sectional shape is an airfoil having a chord line and the airfoil is symmetric about the chord line.

28. The munition of claim 14 wherein the airfoil has a mean camber line and a chord line and the mean camber line is located inward of the chord line.

29. The munition of claim 14 wherein airfoil shape has a leading edge and a trailing edge and the inner flow path has a minimum diameter, and the minimum diameter is located between the leading edge and the trailing edge.

* * * * *